US011302246B2

(12) United States Patent
Ji et al.

(10) Patent No.: US 11,302,246 B2
(45) Date of Patent: Apr. 12, 2022

(54) PIXEL DRIVING CIRCUIT AND DRIVING METHOD THEREOF, DISPLAY PANEL AND DISPLAY DEVICE

(71) Applicant: Xiamen Tianma Micro-Electronics Co., Ltd., Xiamen (CN)

(72) Inventors: Qitai Ji, Xiamen (CN); Qingjun Lai, Xiamen (CN); Xiao Li, Shanghai (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 16/914,490

(22) Filed: Jun. 29, 2020

(65) Prior Publication Data

US 2020/0327852 A1 Oct. 15, 2020

(30) Foreign Application Priority Data

Apr. 28, 2020 (CN) ..... 202010351418.2

(51) Int. Cl.
*G09G 3/30* (2006.01)
*G09G 3/32* (2016.01)

(52) U.S. Cl.
CPC ..... *G09G 3/32* (2013.01); *G09G 2310/0267* (2013.01); *G09G 2310/0272* (2013.01)

(58) Field of Classification Search
CPC ..... G09G 3/32; G09G 2310/0272; G09G 2310/0267; G09G 2300/0819; G09G 2300/0852; G09G 2300/0861; G09G 2320/0233; G09G 2320/045; G09G 3/3233
See application file for complete search history.

(56) References Cited

U.S. PATENT DOCUMENTS 9,275,567 B2 * 3/2016 Kang ..... G09G 3/003
9,455,311 B2 * 9/2016 Shishido ..... H01L 27/124
9,953,567 B2 * 4/2018 Wang ..... G09G 3/3233
2007/0063993 A1 * 3/2007 Shishido ..... G09G 3/3241 345/175

(Continued)

FOREIGN PATENT DOCUMENTS

CN 103927976 A 7/2014
CN 107146580 A 9/2017

(Continued)

*Primary Examiner* — Insa Sadio
(74) *Attorney, Agent, or Firm* — Kilpatrick Townsend & Stockton, LLP

(57) ABSTRACT

Provided are a pixel driving circuit, a driving method, a display panel and a display device. The pixel driving circuit includes: a data writing device, a voltage stabilizing storage device, a driving device and a light-emitting component; where the data writing device is configured for transmitting a data signal voltage; the driving device is configured for generating a driving current according to the data signal voltage transmitted by the data writing device; the voltage stabilizing storage device is configured for storing the data signal voltage transmitted to the driving device; the light-emitting component is configured for emitting light in response to the driving current generated by the driving device; where the voltage stabilizing storage device includes at least two voltage stabilizing storage sub-devices connected in parallel, each voltage stabilizing storage sub-device includes a capacitor, at least one of the voltage stabilizing storage sub-devices includes a switch device.

19 Claims, 20 Drawing Sheets

(56) References Cited

U.S. PATENT DOCUMENTS

| | | | | |
|---|---|---|---|---|
| 2008/0088546 | A1* | 4/2008 | Takasugi | G09G 3/3233 345/76 |
| 2008/0158211 | A1* | 7/2008 | Kwon | G01J 1/32 345/207 |
| 2009/0015166 | A1* | 1/2009 | Kwon | H04N 5/58 315/156 |
| 2012/0146004 | A1* | 6/2012 | Lee | H01L 27/326 257/40 |
| 2013/0037783 | A1* | 2/2013 | Lee | H01L 27/3265 257/40 |
| 2015/0108437 | A1* | 4/2015 | Cho | H01L 27/3248 257/40 |
| 2016/0148565 | A1* | 5/2016 | Wang | G09G 3/3233 345/76 |
| 2017/0018229 | A1* | 1/2017 | Zhang | G09G 3/3233 |
| 2020/0006401 | A1* | 1/2020 | Hwang | H01L 27/1255 |
| 2020/0221554 | A1* | 7/2020 | Chiang | G09G 3/3233 |

FOREIGN PATENT DOCUMENTS

| | | | |
|---|---|---|---|
| CN | 108694905 | A | 10/2018 |
| CN | 106782324 | B | 3/2019 |

* cited by examiner

PIXEL DRIVING CIRCUIT AND DRIVING METHOD THEREOF, DISPLAY PANEL AND DISPLAY DEVICE

CROSS-REFERENCES TO RELATED APPLICATIONS

This application claims the priority to a Chinese patent application No. 202010351418.2 filed at the CNIPA on Apr. 28, 2020, disclosure of which is incorporated herein by reference in its entirety.

FIELD

The present disclosure relates to the field of display techniques and, in particular, to a pixel driving circuit and a driving method thereof, a display panel and a display device.

BACKGROUND

At present, the organic light-emitting diode (OLED) and the liquid crystal display (LCD) are two mainstream display panels in the display field. The OLED has advantages of self-luminescence, low driving voltage and high light-emitting efficiency, etc., and is widely loved by people.

The pixel driving circuit of the OLED usually includes a driving transistor, a switch transistor and a storage capacitor. Due to characteristics of the transistor itself, a gate voltage of the driving transistor when the transistor is turned off can still leak through the transistor, so that the gate voltage of the driving transistor is unstable. Since one plate of the storage capacitor is electrically connected to the gate of the driving transistor, when the gate voltage of the driving transistor is unstable, a storage capacitor leakage is caused, and the gate voltage of the driving transistor is caused to be further unstable. Ultimately, brightness of the light-emitting component is effected, thus causing an uneven display problem.

SUMMARY

The present disclosure provides a pixel driving circuit and a driving method thereof, a display panel and a display device for improving the problem of unstable gate voltage of the driving transistor caused by capacitor leakage, and improving the display uniformity.

In one embodiment of the present disclosure provides a pixel driving circuit, including: a data writing device, a voltage stabilizing storage device, a driving device, and a light-emitting component; where the data writing device is configured for transmitting a data signal voltage; the driving device is configured for generating a driving current according to the data signal voltage transmitted by the data writing device; the voltage stabilizing storage device is configured for storing the data signal voltage transmitted to the driving device; the light-emitting component is configured for emitting light in response to the driving current generated by the driving device; where the voltage stabilizing storage device includes at least two voltage stabilizing storage sub-devices connected in parallel, each voltage stabilizing storage sub-device of the at least two voltage stabilizing storage sub-devices includes a capacitor, at least one of the voltage stabilizing storage sub-devices includes a switch device, and the switch device is connected between the capacitor and the driving device.

In one embodiment of the present disclosure further provides a pixel driving method, which is applied to a pixel driving circuit. The pixel driving circuit includes a data writing device, a voltage stabilizing storage device, a driving device and a light-emitting component, where the data writing device is configured for transmitting a data signal voltage; the driving device is configured for generating a driving current according to the data signal voltage transmitted by the data writing device; the voltage stabilizing storage device is configured for storing the data signal voltage transmitted to the driving device; the light-emitting component is configured for emitting light in response to the driving current generated by the driving device; where the voltage stabilizing storage device includes at least two voltage stabilizing storage sub-devices connected in parallel, each voltage stabilizing storage sub-device of the at least two voltage stabilizing storage sub-devices includes a capacitor, at least one of the voltage stabilizing storage sub-devices includes a switch device, and the switch device is connected between the capacitor and the driving device;

The driving method includes: in a data writing stage, transmitting, by the data writing device, a data signal voltage, and storing, by the voltage stabilizing storage device, the data signal voltage; in a light-emitting stage, the each voltage stabilizing storage sub-device storing the data signal voltage includes an effective voltage stabilizing period, and effective voltage stabilizing periods of the at least two voltage stabilizing storage sub-devices at least do not overlap partially; and where within the effective voltage stabilizing period, the switch device in the voltage stabilizing storage sub-device is in a conductive state.

In one embodiment of the present disclosure further provides a display panel. The display panel includes a pixel driving circuit described in any one of the embodiments of the present disclosure.

In one embodiment of the present disclosure provides a display device. The display device includes the display panel described in any one of the embodiments of the present disclosure.

DETAILED DESCRIPTION

Figure 1:
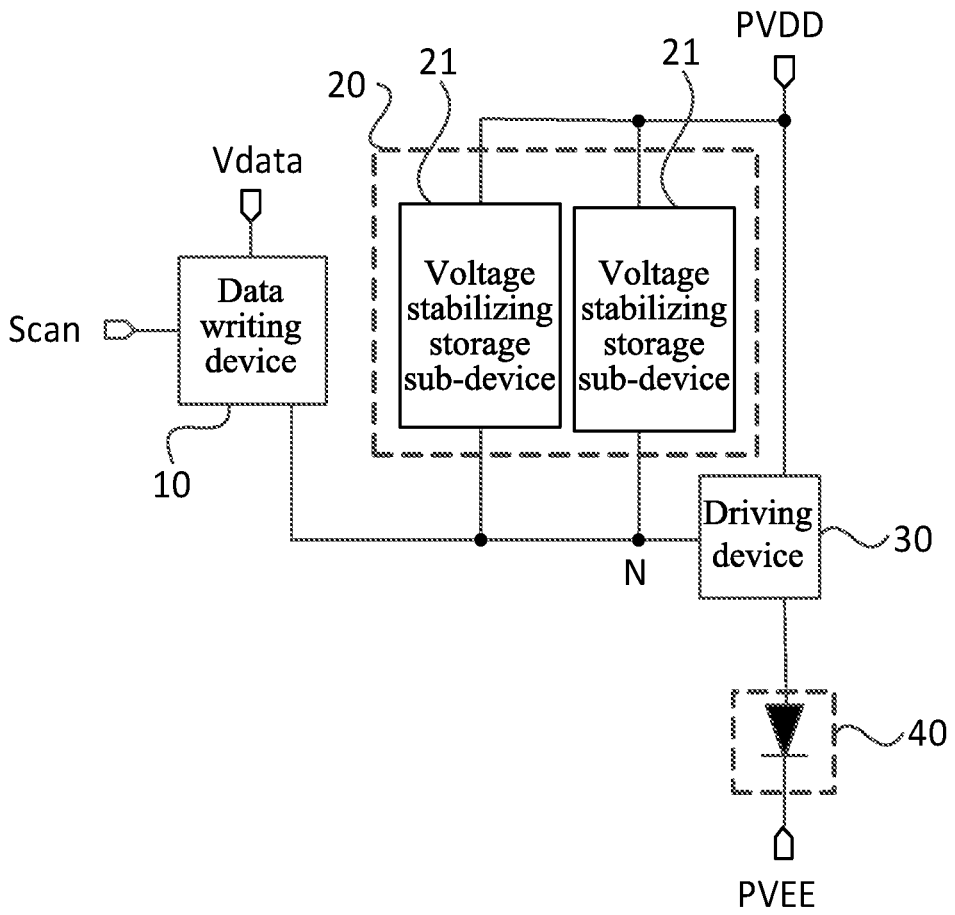
FIG. 1 is a structural diagram of a pixel driving circuit provided by an embodiment of the present disclosure.

Hereinafter the present disclosure will be further described in detail in conjunction with the drawings and embodiments. It is to be understood that the embodiments set forth below are intended to illustrate and not to limit the present disclosure. Additionally, it is to be noted that, for ease of description, only part, not all, of the structures related to the present disclosure are illustrated in the drawings.

In view of problems in background, an embodiment of the present disclosure provides a pixel driving circuit. The pixel driving circuit includes: a data writing device, a voltage stabilizing storage device, a driving device, and a light-emitting component.

The data writing device is configured for transmitting a data signal voltage.

The driving device is configured for generating a driving current according to the data signal voltage transmitted by the data writing device.

The voltage stabilizing storage device is configured for storing the data signal voltage transmitted to the driving device.

The light-emitting component is configured for emitting light in response to the driving current generated by the driving device.

The voltage stabilizing storage device includes at least two voltage stabilizing storage sub-devices connected in parallel, each voltage stabilizing storage sub-device the at least two voltage stabilizing storage sub-devices includes a capacitor, at least one of the voltage stabilizing storage sub-devices includes a switch device, and the switch device is connected between the capacitor and the driving device.

In one embodiment, by controlling the on-state or off-state of the switch device, a period (which is also called an effective voltage stabilization period) for stabilizing the voltage of the control terminal of the driving device of the capacitor may be flexibly configured. Compared with the related art, using a capacitor to stable the control terminal voltage of the driving device causes a leakage amount of the voltage stabilizing storage device to be concentrated on one capacitor. The leakage amount of the voltage stabilizing storage device in the embodiment of the present disclosure is shared by at least two capacitors, and the leakage amount on each capacitor is reduced, so that a voltage change amount of the control terminal is reduced, so that the problem of uneven display in the related art may be improved, and the purpose of improving the display effect may be achieved.

FIG. 1 is a structural diagram of a pixel driving circuit according to an embodiment of the present disclosure. Referring to FIG. 1, the pixel driving circuit includes: a data writing device 10, a voltage stabilizing storage device 20, a driving device 30 and a light-emitting component 40; the voltage stabilizing storage device 20 includes at least two voltage stabilizing storage sub-devices connected in parallel 21, each voltage stabilizing storage sub-device 21 includes a capacitor, at least one of the voltage stabilizing storage sub-devices 21 includes a switch device, and the switch device is connected between the capacitor and the driving device 30. In one embodiment of the present disclosure, the data writing device 10 is electrically connected to a scanning signal terminal Scan, a data signal terminal Vdata and a control terminal N of the driving device 30. The voltage stabilizing storage device 20 is electrically connected between a first power signal terminal PVDD and the control terminal N of the driving device 30, each switch device is electrically connected to a switch control signal terminal, the driving device 30 is electrically connected to the first power signal terminal PVDD and an anode of the light-emitting component 40, and a cathode of the light-emitting component 40 is electrically connected to a second power signal terminal PVEE.

In one embodiment of the present disclosure, in the data writing stage, the data writing device 10 transmits the data signal voltage of the data signal terminal Vdata to the control terminal N of the driving device 30 under the control of a signal of the scanning signal terminal Scan, and the voltage stabilizing storage device 20 stores the data signal voltage, specifically, if capacitors in the voltage stabilizing storage sub-devices 21 are directly connected to the control terminal N of the driving device 30 through a wire, the capacitors may store the data signal voltage; if the voltage stabilizing storage sub-devices 21 includes a switch device, and the switch device is turned on under the control of a signal of the switch control signal terminal, the capacitors in the voltage stabilizing storage sub-devices 21 to which the switch device belongs may store the data signal voltage; if the voltage stabilizing storage sub-devices 21 include the switch device, the switch device is cut off under the control of the signal of the switch control signal terminal SK, the capacitor in the voltage stabilizing storage sub-devices 21 to which the switch device belongs does not store the data signal voltage. It can be seen that when the voltage stabilizing storage device includes at least three voltage stabilizing storage sub-devices connected in parallel, by controlling the on-state or off-state of the switch device in each voltage stabilizing storage sub-device 21, the number of capacitors storing the data signal voltage may be flexibly configured, the capacitance value of the voltage stabilizing storage device 20 may be flexibly configured, so that the capacitance value of the voltage stabilizing storage device 20 is matched with the driving frequency. That is, the higher the driving frequency is, the shorter the time length of the data writing stage is, and the smaller the number of capacitors storing the data signal voltage is not to cause the insufficient charging.

In one embodiment, in the light-emitting stage, the driving device 30 generates a driving current according to the data signal voltage transmitted by the data writing device 10, the light-emitting component 40 emits light in response to the driving current, and the voltage stabilizing storage device 20 is configured for stabilizing a voltage of the control terminal N of the driving device 30 to stabilize the current flowing through the light-emitting component 40, making the light-emitting component 40 have stable light-emitting brightness. The voltage stabilizing storage sub-device 21 storing the data voltage signal in the voltage stabilizing storage device 20 is configured for stabilizing the voltage of the control terminal N of the driving device 30, specifically, in the voltage stabilizing storage sub-device 21 storing the data voltage signal, if the capacitor in the voltage stabilizing storage sub-device 21 is directly connected to the control terminal N of the driving device 30 through a wire, the capacitor stabilizes the voltage of the control terminal N of the driving device 30 during the entire light-emitting stage; if the voltage stabilizing storage sub-device 21 includes a switch device, the capacitor in the voltage stabilizing storage sub-device 21 to which the switch device belongs stabilizes the voltage of the control terminal N of the driving device 30 when the switch device is turned on. It can be seen that by controlling a specific on-time of the switch device in each voltage stabilizing storage sub-device 21, the specific time that the capacitance in each voltage stabilizing storage sub-device 21 may be flexibly configured to stabilize the voltage of the control terminal N of the driving device 30 (which is called the effective voltage stabilizing period of the voltage stabilizing storage sub-device 21).

It can be understood that, during the data writing stage, the number of voltage stabilizing storage sub-devices 21 storing the data voltage signal may be configured by those skilled in the art according to the actual situation. During the light-emitting stage, the effective voltage stabilizing period of each voltage stabilizing storage sub-device 21 storing the data signal voltage can also be configured by according to the actual situation.

Figure 2:
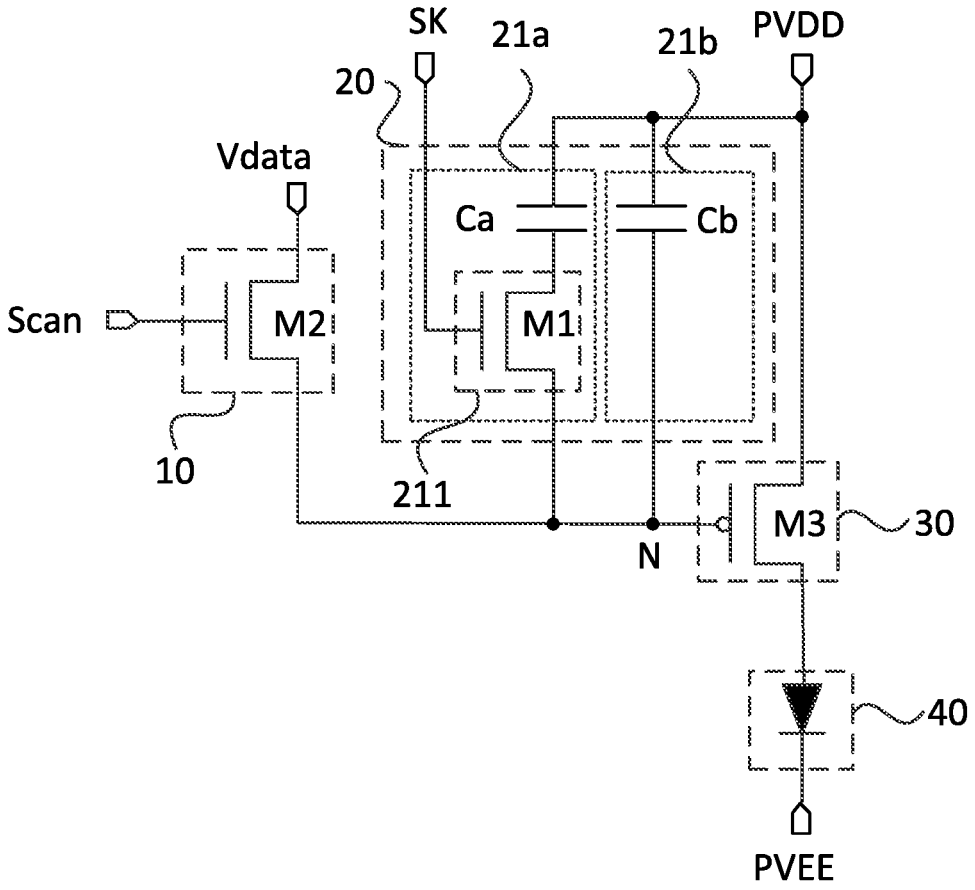
FIG. 2 is a schematic diagram of circuit elements of a pixel driving circuit provided by an embodiment of the present disclosure.
Figure 3:
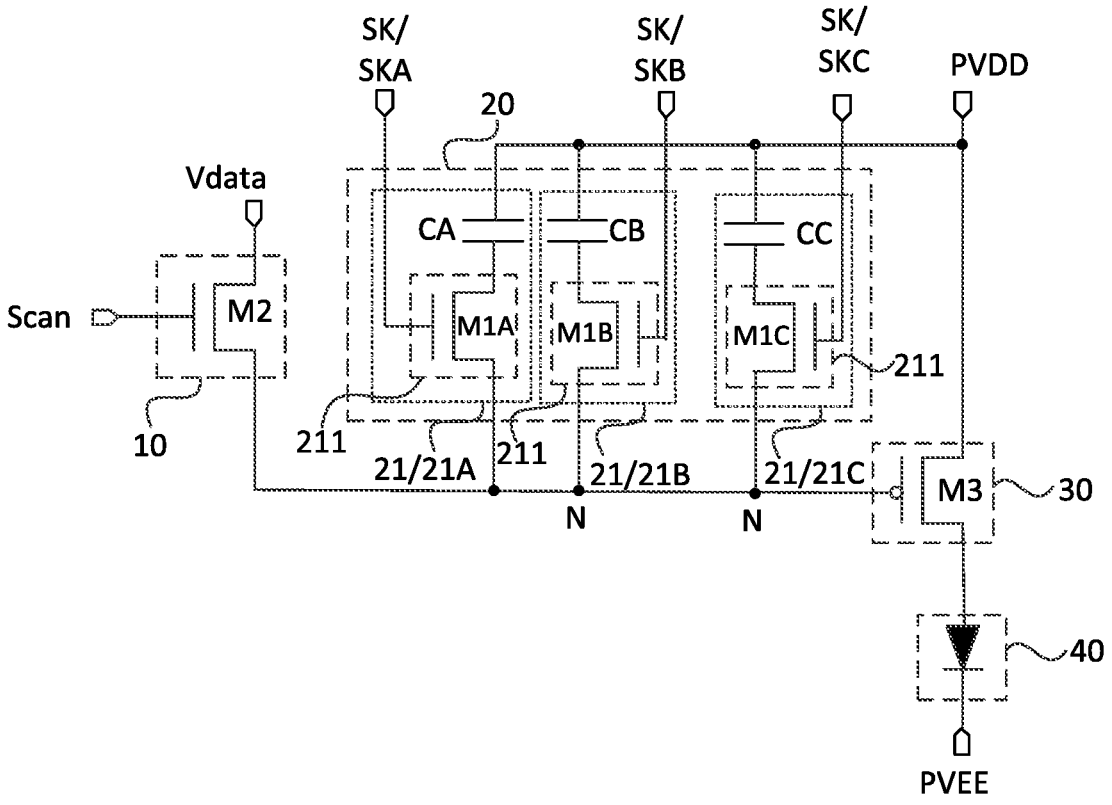
FIG. 3 is a schematic diagram of circuit elements of another pixel driving circuit provided by an embodiment of the present disclosure.

FIG. 2 is a schematic diagram of circuit elements of a pixel driving circuit provided by an embodiment of the present disclosure. FIG. 3 is a schematic diagram of circuit elements of another pixel driving circuit provided by an embodiment of the present disclosure. FIGS. 2 and 3, in one embodiment of the present disclosure, a first terminal of the driving device 30 is electrically connected to the first power signal terminal PVDD, and the light-emitting component 40 is electrically connected between a second terminal of the driving device 30 and the second power signal terminal PVEE.

Still referring to FIGS. 2 to 3, in one embodiment of the present disclosure, the switch device 211 includes a first transistor M1.

In one embodiment of the present disclosure, a gate of the first transistor M1 is electrically connected to the corresponding switch signal control terminal SK. In one embodiment, in FIG. 3, a gate of a first transistor MA is electrically connected to a switch signal control terminal SKA, and a gate of a first transistor M1B It is electrically connected to a switch signal control terminal SKB, a gate of a first transistor M1C is electrically connected to a switch signal control terminal SKC. A first electrode of the first transistor M1 is electrically connected to its corresponding capacitor, for example, in FIG. 3, a first electrode of the first transistor M1A is electrically connected to the capacitor CA, a first electrode of the first transistor M1B is electrically connected to the capacitor CB, a first electrode of the first transistor M1C is electrically connected to the capacitor CC, and a second electrode of the first transistor M1 is electrically connected to the control terminal N of the driving device 30.

In one embodiment of the present disclosure, the first transistor M1 may be a P-type transistor, the first transistor M1 may also be an N-type transistor, which is shown in FIGS. 2 and 3. In one embodiment of the present disclosure, the first transistor M1 includes an oxide transistor or a double gate structure. In this way, a leakage current when the first transistor M1 is cut off may be reduced, and when the light-emitting device emits light, it is beneficial to reduce the interference of the leakage current of the first transistor M1 on the driving device 30, to avoid the driving device 30 driving the driving current of the light-emitting device.

Still referring to FIGS. 2 to 3, in one embodiment of the present disclosure, the data writing device includes a second transistor M2.

In one embodiment of the present disclosure, a gate of the second transistor M2 is electrically connected to the scanning signal terminal Scan, a first electrode of the second transistor M2 is electrically connected to the data signal terminal Vdata, and a second electrode of the second transistor M2 is electrically connected to the control terminal N of the driving device 30.

In one embodiment of the present disclosure, the second transistor M2 may be the P-type transistor, the second transistor M2 may also be the N-type transistor, which is shown in FIGS. 2 and 3. In one embodiment of the present disclosure, the second transistor M2 includes the oxide transistor or the double gate structure. In this way, a leakage current when the second transistor M2 is cut off may be reduced, and when the light-emitting device emits light, it is beneficial to reduce the interference of the leakage current of the second transistor M2 on the driving device 30, to avoid the driving device 30 driving the driving current of the light-emitting device.

Referring to FIGS. 2 to 3, in one embodiment of the present disclosure, the driving device includes a third transistor M3.

In one embodiment of the present disclosure, a gate of the third transistor M3 is electrically connected to the data writing device 10 and the voltage stabilizing storage device 20, a first electrode of the third transistor M3 is electrically connected to the first power signal terminal PVDD, and a second electrode of the third transistor M3 is electrically connected to an anode of the light-emitting component 40, and a cathode of the light-emitting component 40 is electrically connected to the second power signal terminal PVEE.

It should be noted that FIGS. 2 and 3 only exemplarily show that the third transistor M3 is the P-type transistor, but this is not a limitation to the present disclosure. In other embodiments, the third transistor M3 may also be configured to be the N-type transistor.

Referring to FIG. 3, in one embodiment of the present disclosure, each voltage stabilizing storage sub-device 21 includes a switch device 211, and the switch device 211 is connected between the capacitor and the driving device 30.

For each voltage stabilizing storage sub-device 21, whether or not the included capacitor remains to being connected to the driving device 30 may be flexibly configured to avoid uneven use frequency of each capacitor. In one embodiment, some capacitors are configured for a long time, and the use frequency of some capacitors is very low, so it is helpful to extend the lifespan of the pixel driving circuit.

In one embodiment of the present disclosure, the capacitor in each voltage stabilizing storage sub-device 21 has a same capacitance.

During the data writing stage, the capacitor in each voltage stabilizing storage sub-device 21 may be simultaneously charged, avoiding the problem of long charging time since part of capacitors are completely charged and part of capacitors are not completely charged.

In one embodiment of the present disclosure, the capacitors in the at least two voltage stabilizing storage sub-devices 21 have a same capacitance.

Some embodiments may flexibly configure the capacitance of each voltage stabilizing storage sub-device 21 according to the actual situation, so that a total capacitance of all capacitors configured for storing the data signal voltage in the data writing stage has multiple choices, improving adaptability of the driving frequency. Exemplarily, it is assumed that capacitances of a capacitor CA, a capacitor CB, and a capacitor CC in FIG. 3 are different, respectively are $C_A$, $C_B$ and $C_C$, the total capacitance of all capacitors configured for storing the data signal voltage during the data writing stage may be $C_A+C_B$, $C_A+C_C$, $C_B+C_C$ or $C_A+C_B+C_C$.

Referring to FIG. 2, in one embodiment of the present disclosure, the voltage stabilizing storage device 20 includes a first voltage stabilizing storage sub-device 21*a* and a voltage stabilizing storage sub-device 21*b*, and the first voltage stabilizing storage sub-device 21*a* includes a first capacitor Ca. A first electrode of the first capacitor Ca is connected to the first power signal terminal PVDD, a second electrode of the first capacitor is connected to the driving device 30. The second voltage stabilizing storage sub-device 21*b* includes a second capacitor Cb and a switch device 211, and the switch device 211 is connected to the second capacitor Cb and the driving device 30. In one embodiment of the present disclosure, the capacitance of the first capacitor Ca is greater than the capacitance of the second capacitor Cb.

In one embodiment of the present disclosure, in the data writing stage, the data writing device 10 transmits the data signal voltage of the data signal terminal Vdata to the control terminal N of the driving device 30 under the control of the signal of the scanning signal terminal Scan, the first capacitor Ca and the second capacitor Cb store the data signal voltage. In the light-emitting stage, the driving device 30 generates a driving current according to the data signal voltage, and the light-emitting component 40 emits light in response to the driving current, where the light-emitting stage includes a first light-emitting stage and a second light-emitting stage which are consecutive in time.

In a first light-emitting stage, the first capacitor Ca is configured for stabilizing the voltage of the control terminal of the driving device 30. At an end occasion of the first light-emitting stage, the voltage of the control terminal N of the driving device 30 is raised to:

$$V_{N1} = V_{N0} + \frac{\Delta Q \times \frac{t_1}{t_1+t_2}}{c_1}.$$

In the first light-emitting stage, although the voltage of the control terminal N of the driving device 30 changes, the changing amount is small, that is, a potential difference between the first electrode of the first transistor M1 and the second electrode of the first transistor M1 is small, therefore, a leakage current of the first transistor M1 in the off state is not considered, that is, when a first switch transistor M1 is cut off, the capacitor in the voltage stabilizing storage sub-device 21 to which the first switch transistor belongs is not leaked.

In the second light-emitting stage, the first capacitor Ca and the second capacitor Cb are used together for stabilizing the voltage of the control terminal of the driving device 30. At a starting occasion of the second light-emitting stage, the voltage of the control terminal N of the driving device 30 is pulled down to:

$$V_{N2} = V_{N0} + \frac{\Delta Q \times \frac{t_1}{t_1+t_2}}{c_1+c_2}.$$

$V_{N0}$ is the voltage (i.e., the data signal voltage) of the control terminal of the driving device 30 at the starting occasion of the light-emitting stage (i.e., the starting occasion of the first light-emitting stage), ΔQ is total leakage charges of the voltage stabilizing storage device 20 in the light-emitting stage, $t_1$ is a time length of the first light-emitting stage, $t_2$ is a time length of the second light-emitting stage, $c_1$ is the capacitance of the first capacitor Ca, $c_2$ is the capacitance of the second capacitor Cb.

It can be seen that when the second capacitor Cb and the control terminal N of the driving device 30 change from disconnected to connected, compared with a case where the capacitance of the first capacitor Ca is less than the capacitance of the second capacitor Cb, when the capacitance of the first capacitor Ca is greater than the capacitance of the second capacitor Cb, a voltage jump of the control terminal N of the driving device 30 is smaller, and a jump of the driving current generated by the driving device 30 is smaller, thus the changing of the light-emitting brightness of the light-emitting component 40 is smaller to avoid affecting the display effect.

Figure 4:
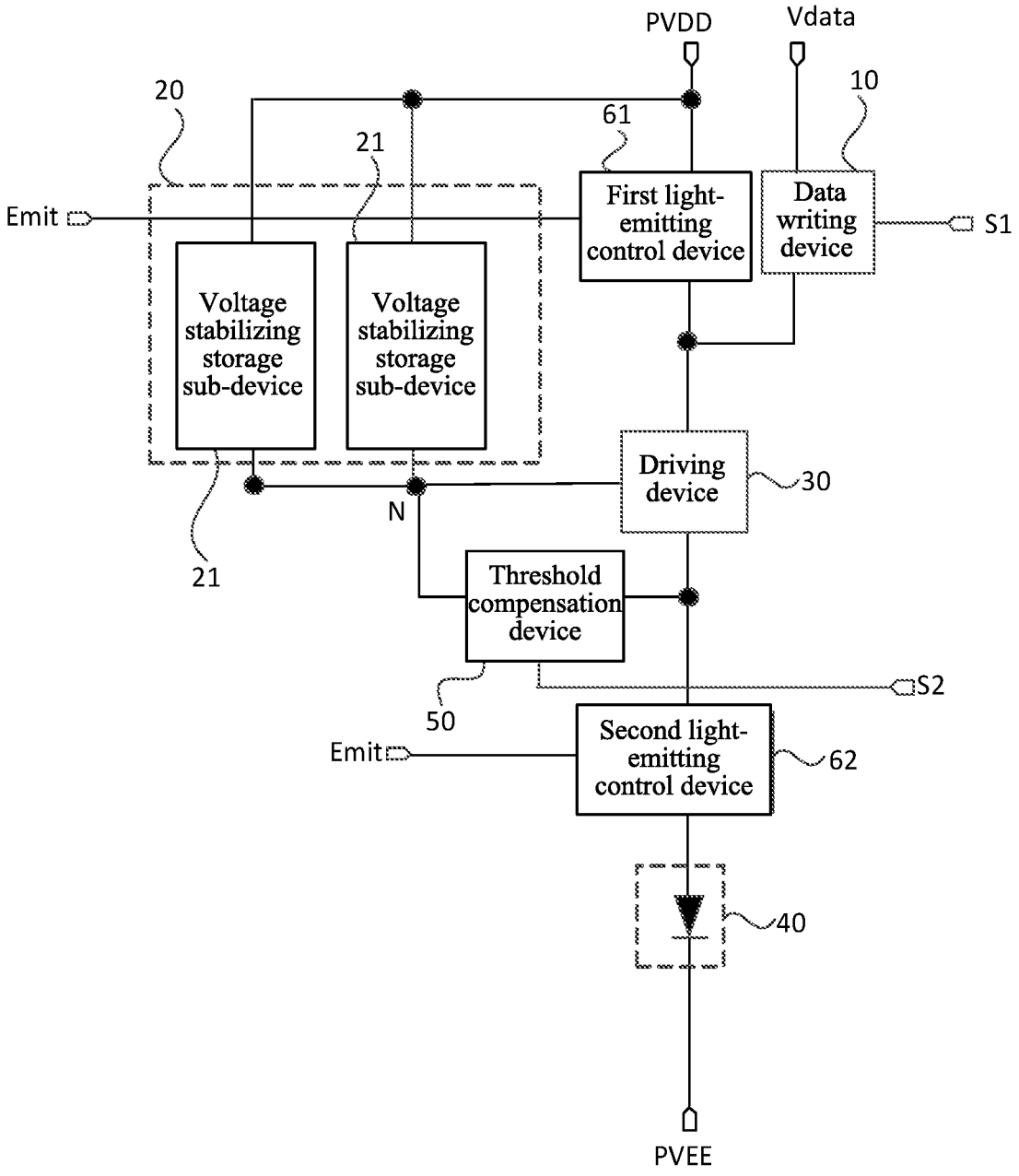
FIG. 4 is a structural diagram of another pixel driving circuit provided by an embodiment of the present disclosure.

FIG. 4 is a structural diagram of another pixel driving circuit provided by an embodiment of the present disclosure. Referring to FIG. 4, the pixel driving circuit includes: a data writing device 10, a voltage stabilizing storage device 20, a driving device 30 and a light-emitting component 40; the voltage stabilizing storage device 20 includes at least two voltage stabilizing storage sub-devices connected in parallel 21, each voltage stabilizing storage sub-device 21 includes a capacitor, at least one of the voltage stabilizing storage sub-devices 21 includes a switch device 211, and the switch device 211 is connected between the capacitor and the driving device 30. In one embodiment of the present disclosure, the pixel driving circuit further includes a threshold compensation device 50 and a light-emitting control device. The beneficial effect that the threshold compensation device 50 is able to produce will not be described in detail here, and will be explained later when the working process of the pixel driving circuit is described by way of an example.

The data writing device 10 is configured for transmitting the data signal voltage; the threshold compensation device 50 is configured for compensating a threshold voltage of the driving device 30 to the control terminal N of the driving device 30; the voltage stabilizing storage device 20 is configured for storing the data signal voltage transmitted to the driving device 30 in the data writing stage, and stabilizing voltage of the control terminal N of the driving device 30 in the light-emitting stage; the light-emitting control device is configured for controlling the driving device 30 to generate a driving current to flow into the light-emitting component 40; the driving device 30 is configured for generating the driving current according to the data signal voltage transmitted by the data writing device 1020; the light-emitting component 40 is configured for emitting light in response to the driving current generated by the driving device 30.

In one embodiment of the present disclosure, the voltage stabilizing storage device 20 is electrically connected between a first power signal terminal PVDD and the control terminal N of the driving device 30; each switch device 211 is electrically connected to a switch control signal terminal SK.

In one embodiment of the present disclosure, the light-emitting control device includes a first light-emitting control device 61 and a second light-emitting control device 62, the first light-emitting control device 61 is electrically connected to a light-emitting control signal terminal Emit, a first power signal terminal PVDD and a first terminal of the driving device 30; a second light-emitting control device 62 is electrically connected to the light-emitting control signal terminal Emit, a second terminal of the driving device 30 and an anode of the light-emitting component 40, and a cathode of the light-emitting component 40 is electrically connected to a second power signal terminal PVEE.

Figure 5:
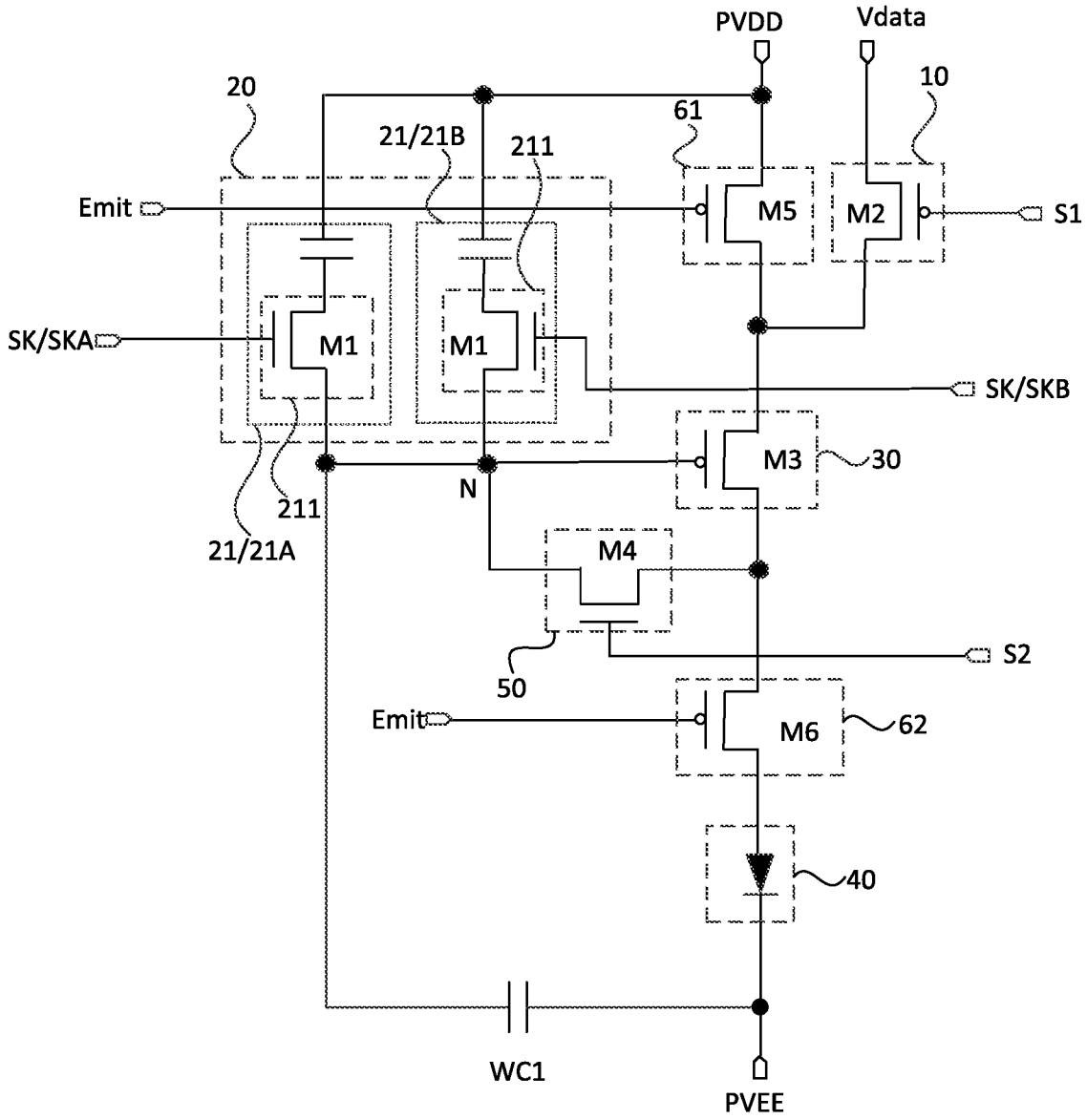
FIG. 5 is a schematic diagram of circuit elements of another pixel driving circuit provided by an embodiment of the present disclosure.
Figure 6:
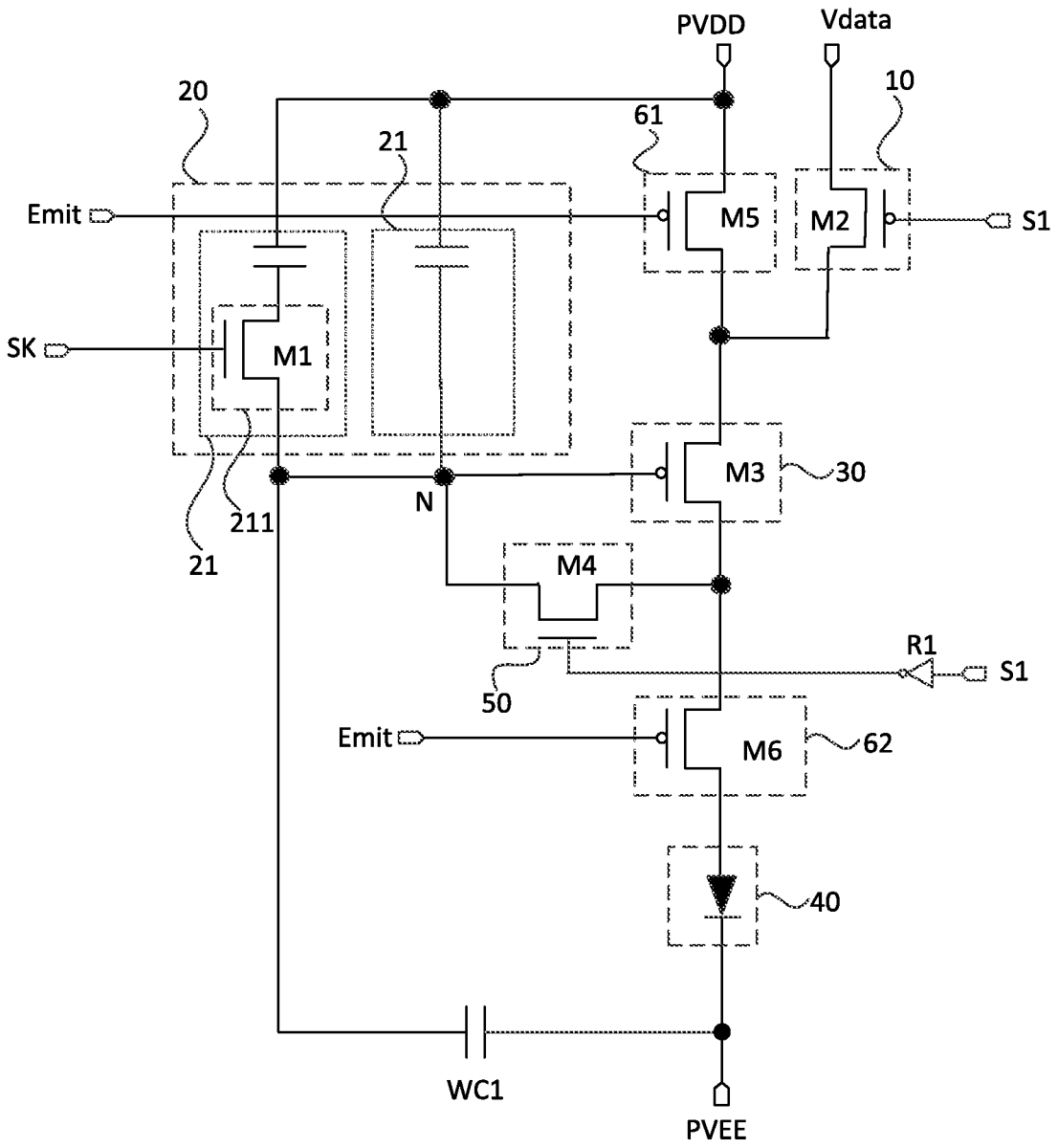
FIG. 6 is a schematic diagram of circuit elements of another pixel driving circuit provided by an embodiment of the present disclosure.

FIG. 5 is a schematic diagram of circuit elements of another pixel driving circuit provided by an embodiment of the present disclosure. FIG. 6 is a schematic diagram of circuit elements of another pixel driving circuit provided by an embodiment of the present disclosure. FIGS. 5 and 6, in one embodiment of the present disclosure, the first light-emitting control device 61 includes a fifth transistor M5, a first electrode of the fifth transistor M5 is electrically connected to the first power signal terminal PVDD, and a second electrode of a sixth transistor M6 is electrically connected to a first terminal of the driving device 30, and a gate of the sixth transistor M6 is electrically connected to the light emitting control signal terminal Emit. The second light-emitting control device 62 includes the sixth transistor M6, a first electrode of the sixth transistor M6 is electrically connected to the second terminal of the driving device 30, a second electrode of the sixth transistor M6 is electrically connected to the anode of the light-emitting component 40, the gate of the transistor M6 is electrically connected to the light-emitting control signal terminal Emit, and the cathode of the light-emitting component 40 is electrically connected to the second power signal terminal PVEE.

Referring to FIGS. 5 to 6, in one embodiment of the present disclosure, the driving device includes a third transistor M3. In one embodiment of the present disclosure, a gate of the third transistor M3 is electrically connected to one terminal of the threshold compensation device 50 and the voltage stabilizing storage device 20 and the threshold compensation device 50, and the first electrode of the third transistor M3 is electrically connected to the data writing device 10 and the first light-emitting control device 61. The second electrode of the third transistor M3 is electrically connected to the other terminal of the second light-emitting control device 62 and the threshold compensation device 50.

Referring to FIG. 5, in one embodiment of the present disclosure, the data writing device 10 is electrically connected to a first scanning signal terminal S1, the data signal terminal Vdata and the first terminal of the driving device 30; the threshold compensation device 50 is electrically connected to a second scanning signal terminal S2, the second terminal of the driving device 30 and the control terminal N of the driving device 30. In one embodiment of the present disclosure, the data writing device 10 includes a second transistor M2, and the second transistor M2 may be a P-type transistor, as shown in FIG. 5 and FIG. 6; the second transistor M2 may also be an N-type transistor. The threshold compensation device 50 includes a fourth transistor M4, and the fourth transistor M4 may be the P-type transistor, and the fourth transistor M4 may also be the N-type transistor, as shown in FIGS. 5 and 6. In one embodiment of the present disclosure, a first electrode of the second transistor M2 is electrically connected to the data signal terminal Vdata, a second electrode of the second transistor M2 is electrically connected to the first terminal of the driving device 30, and a gate of the second transistor M2 is electrically connected to the first scanning signal terminal S1. A first electrode of the fourth transistor M4 is electrically connected to the control terminal N of the driving device 30, a second electrode of the fourth transistor M4 is electrically connected to the second terminal of the driving device 30, a gate of the fourth transistor M4 is electrically connected to a second scanning signal terminal S2.

Referring to FIG. 6, in one embodiment of the present disclosure, the data writing device 10 is electrically connected to the first scanning signal terminal S1, the data signal terminal Vdata, and the first terminal of the driving device 30; the pixel driving circuit further includes a first inverter R1, an input terminal of the first inverter R is electrically connected to the first scanning signal terminal S1; the threshold compensation device 50 is electrically connected to an output terminal of the first inverter R1, the second terminal of the driving device 30 and the control terminal N of the driving device 30. In one embodiment of the present disclosure, the data writing device 10 includes a second transistor M2, the second transistor M2 is a P-type transistor, the threshold compensation device 50 includes a fourth transistor M4, and the fourth transistor M4 is an oxide-type transistor. In one embodiment of the present disclosure, a first electrode of the second transistor M2 is electrically connected to the data signal terminal Vdata, a second electrode of the second transistor M2 is electrically connected to the first terminal of the driving device 30, and a gate of the second transistor M2 is electrically connected to the first scanning signal terminal S1. A first electrode of the fourth transistor M4 is electrically connected to the control terminal N of the driving device 30, a second electrode of the fourth transistor M4 is electrically connected to the second terminal of the driving device 30, a gate of the fourth transistor M4 is electrically connected to the output terminal of the first inverter R1, the output terminal of the first inverter R1 is electrically connected to the first scanning signal terminal S1. In this way, the signal of the first scanning signal terminal S1 may control the second transistor M2 and the fourth transistor M4 to be simultaneously turned on or cut off at the same time, which is beneficial to reduce the number of control terminals on a chip configured for driving the pixel driving circuit, and is beneficial to save the chip cost. It may be understood that FIG. 6 exemplarily shows that the first inverter R1 is disposed between the first scanning signal terminal S1 and the threshold compensation device 50. In some embodiments, the first inverter R1 may also be disposed between the first scanning signal terminal S1 and the data writing device 10, which will not be repeated here.

It can be understood that the fourth transistor M4 includes an oxide crystal, which can reduce a leakage current when the fourth transistor M4 is cut off. To reduce a leakage current tube when the fourth transistor M4 is cut off, the fourth transistor M4 may also be a multi-gate structure, such as a double-gate structure. In this way, when the light-emitting device emits light, it is beneficial to reduce the interference of the leakage current of the fourth transistor M4 on the driving device 30, to avoid the driving device 30 driving the driving current of the light-emitting device.

Referring to FIGS. 5 and 6, in one embodiment of the present disclosure, the pixel driving circuit further includes a first voltage stabilizing capacitor WC1, which is electrically connected between the control terminal N of the driving device 30 and the second power signal terminal PVEE.

It can be understood that a direction of the leakage current of the capacitor in the voltage stabilizing storage sub-device 21 flows from the first power signal terminal PVDD to the control terminal N of the driving device 30, which will increase an voltage of the control terminal N of the driving device 30; when the voltage of the control terminal N of the driving device 30 changes, a potential difference between two plates of the first voltage stabilizing capacitor WC1 changes, and a current flows through the first voltage stabilizing capacitor WC1, due to a voltage of a signal of the second power signal terminal PVEE is lower than the voltage of the control terminal N of the driving device 30, therefore, the current flows from the control terminal N of the driving device 30 to the second power signal terminal PVEE, thus, a trend of the voltage of the control terminal N of the driving device 30 decreasing occurs, in other words, configuration of the first voltage stabilizing capacitor WC1 may suppress the voltage of the control terminal N of the driving device 30 from being raised, so that the voltage of the control terminal N of the driving device 30 is more stable and the driving current generated by the driving device 30 is more stable, which in turn makes the light-emitting component 40 more stable in brightness and improves the display uniformity.

Figure 7:
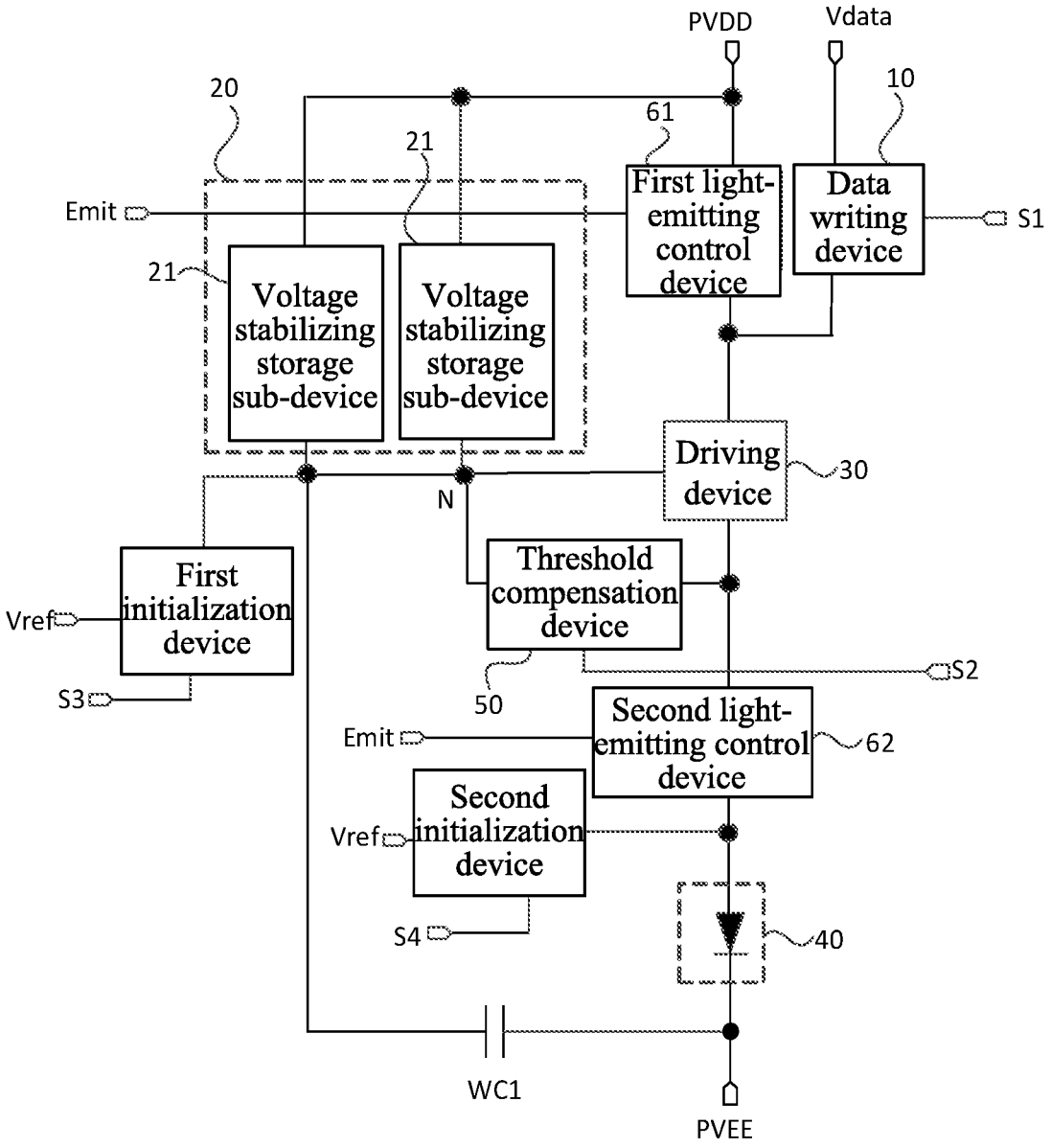
FIG. 7 is a schematic diagram of another pixel driving circuit according to an embodiment of the present disclosure.

FIG. 7 is a schematic diagram of another pixel driving circuit according to an embodiment of the present disclosure. Referring to FIG. 7, in one embodiment of the present disclosure, the pixel driving circuit further includes a first initialization device 71 and a second initialization device 72. The first initialization device 71 is configured for providing an initialization signal to the control terminal N of the driving device 30, and the second initialization device 72 is configured for providing the initialization signal to the anode of the light emitting component 40. The beneficial effect generated by the first initialization device 71 and the second initialization device 72 is not described in detail here, and is explained later when the working process of the pixel driving circuit is described by way of an example.

Figure 8:
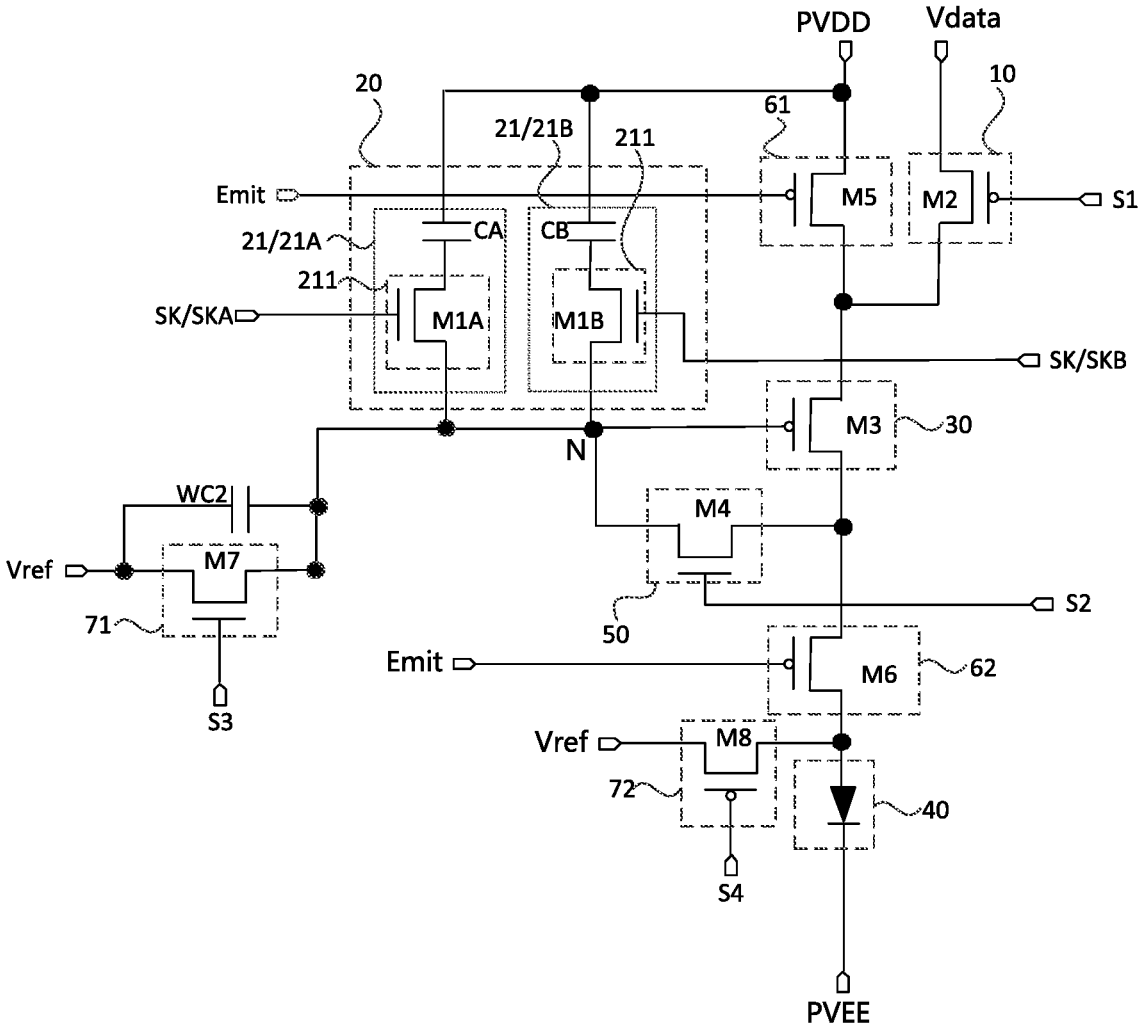
FIG. 8 is a schematic diagram of circuit elements of a pixel driving circuit provided by an embodiment of the present disclosure.
Figure 9:
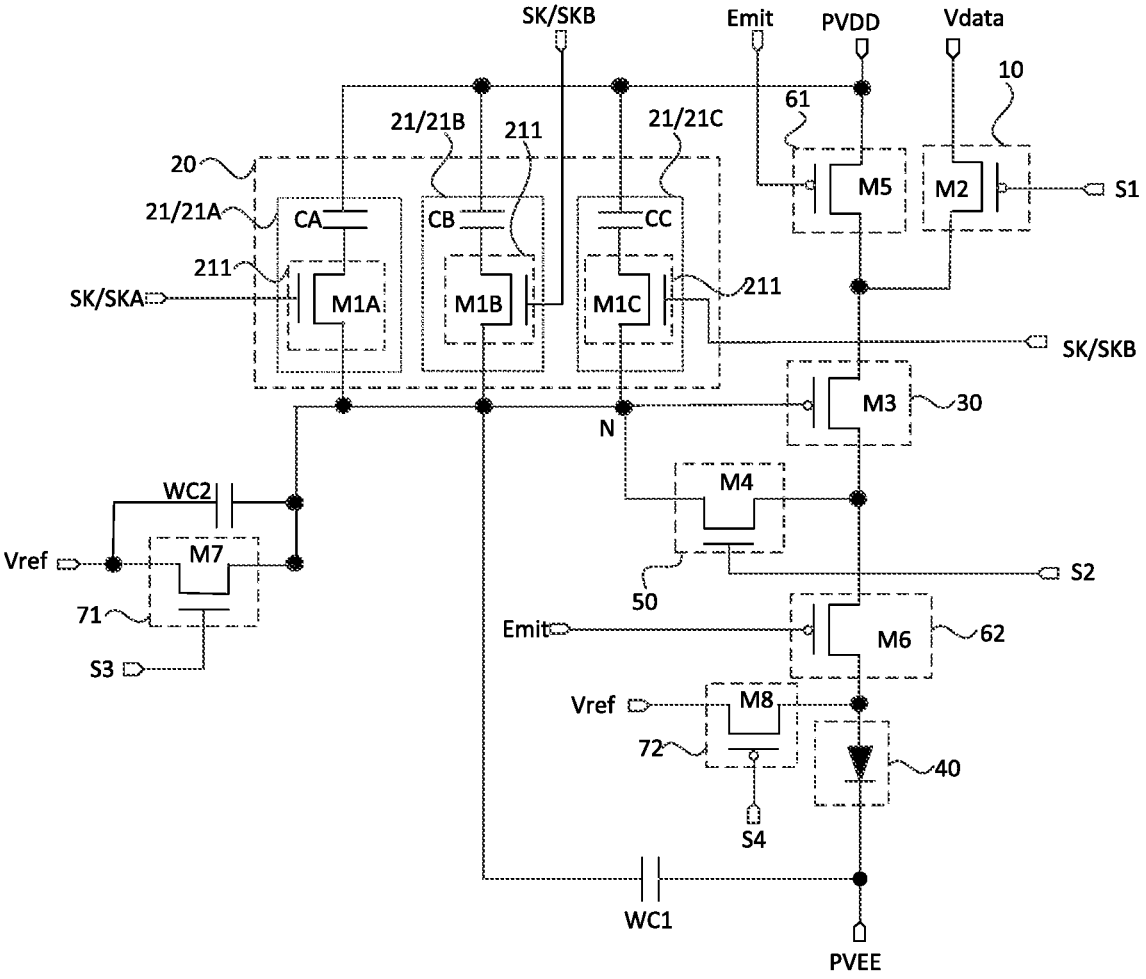
FIG. 9 is a schematic diagram of circuit elements of another pixel driving circuit provided by an embodiment of the present disclosure.

FIG. 8 is a schematic diagram of circuit elements of a pixel driving circuit provided by an embodiment of the present disclosure. FIG. 9 is a schematic diagram of circuit elements of another pixel driving circuit provided by an embodiment of the present disclosure. FIGS. 8 and 9, in one embodiment of the present disclosure, the first initialization device 71 is electrically connected to a third scanning signal terminal, an initialization signal terminal and the control terminal N of the driving device 30; the second initialization device 72 is electrically connected to a fourth scanning signal terminal, the initialization signal terminal and the anode of light-emitting component 40. In one embodiment of the present disclosure, the first initialization device 71 includes a seventh transistor M7, and the seventh transistor M7 may be the P-type transistor; and the seventh transistor M7 may also be the N-type transistor, as shown in FIGS. 8 and 9. The second initialization device 72 includes an eighth transistor M8. The eighth transistor M8 may be the P-type transistor, which is shown in FIGS. 8 and 9. The eighth transistor M8 may also be the N-type transistor. A first electrode of the seventh transistor M7 is electrically connected to the initialization signal terminal Vref, a second electrode of the seventh transistor M7 is electrically connected to the control terminal N of the driving device 30, a gate of the seventh transistor M7 is electrically connected to the third scanning signal terminal S3. A first electrode of the eighth transistor M8 is electrically connected to the initialization signal terminal Vref, a second electrode of the eighth transistor M8 is electrically connected to the anode of the light-emitting device 40, and a gate of the eighth transistor M8 is electrically connected to the fourth scanning signal terminal S4.

Figure 10:
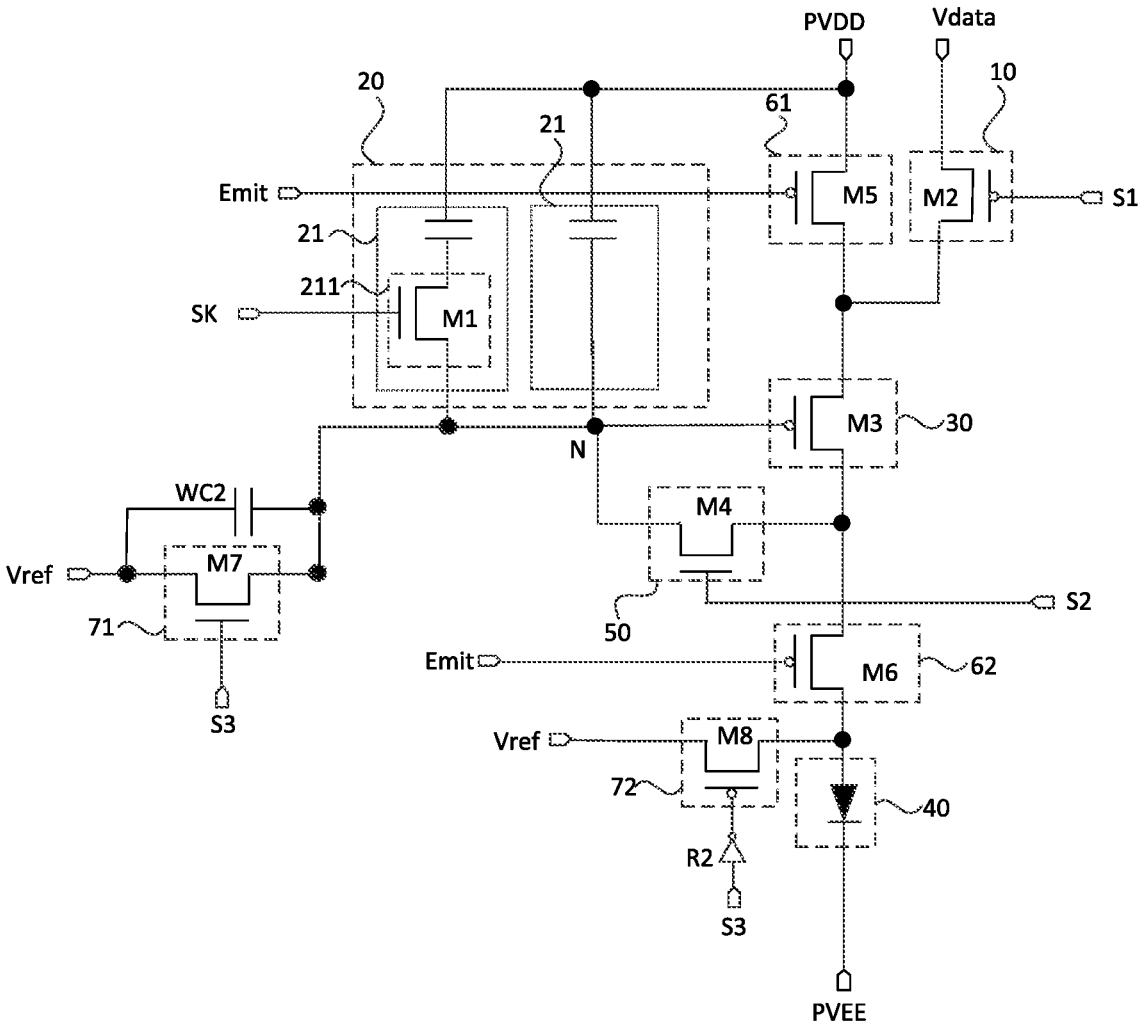
FIG. 10 is a schematic diagram of circuit elements of another pixel driving circuit provided by an embodiment of the present disclosure.

FIG. 10 is a schematic diagram of circuit elements of another pixel driving circuit provided by an embodiment of the present disclosure. Referring to FIG. 10, in one embodiment of the present disclosure, the first initialization device 71 is electrically connected to the third scanning signal terminal, the initialization signal terminal, and the control terminal N of the driving device 30; the pixel driving circuit further includes a second inverter R2, and an input terminal of the second inverter R2 is electrically connected to the third scanning signal terminal, and the second initialization device 72 is electrically connected to an output terminal of the second inverter R2, the initialization signal terminal, and the anode of the light-emitting component 40. In one embodiment of the present disclosure, the first initialization device 71 includes the seventh transistor M7, the seventh transistor M7 is an oxide transistor, the second initialization device 72 includes the eighth transistor M8, and the eighth transistor M8 is the P-type transistor. In one embodiment of the present disclosure, a first electrode of the seventh transistor M7 is electrically connected to the initialization signal terminal Vref, a second electrode of the seventh transistor M7 is electrically connected to the control terminal N of the driving device 30, a gate of the seventh transistor M7 is electrically connected to the third scanning signal terminal S3. A first electrode of the eighth transistor M8 is electrically connected to the initialization signal terminal Vref, a second electrode of the eighth transistor M8 is electrically connected to the anode of the light-emitting device 40, and a gate of the eighth transistor M8 is electrically connected to an output terminal of the second inverter R2, an input terminal of the second inverter R2 is electrically connected to the third scanning signal terminal S3. In this way, a signal of the third scanning signal terminal S3 may control the seventh transistor M7 and the eighth transistor M8 to be simultaneously turned on or cut off at the same time, which is beneficial to reduce the number of control terminals on a chip configured for driving the pixel driving circuit, and is beneficial to save the chip cost. It may be understood that FIG. 10 exemplarily shows that the second inverter R2 is disposed between the third scanning signal terminal S3 and the second initialization device 72. In some embodiments, the second inverter R2 may also be disposed between the third scanning signal terminal S3 and the second initialization device 72, which will not be repeated here.

Still referring to FIGS. 8 to 10, in one embodiment of the present disclosure, the pixel driving circuit further includes a second voltage stabilizing capacitor WC2, which is electrically connected between the control terminal N of the driving device 30 and the initialization signal terminal.

It can be understood that a direction of the leakage current of the capacitor in the voltage stabilizing storage sub-device 21 flows from the first power signal terminal PVDD to the control terminal N of the driving device 30, which will increase an voltage of the control terminal N of the driving device 30; when the voltage of the control terminal N of the driving device 30 changes, a potential difference between two plates of the second voltage stabilizing capacitor WC2 changes, and a current flows through the second voltage stabilizing capacitor WC2, due to a voltage of a signal of the initialization signal terminal Vref is lower than the voltage of the control terminal N of the driving device 30, therefore, the current flows from the control terminal N of the driving device 30 to the initialization signal terminal Vref, thus, a trend of the voltage of the control terminal N of the driving device 30 decreasing occurs, in other words, configuration of the second voltage stabilizing capacitor WC2 may suppress the voltage of the control terminal N of the driving device 30 from being raised, so that the voltage of the control terminal N of the driving device 30 is more stable and the driving current generated by the driving device 30 is more stable, which in turn makes the light-emitting component 40 more stable in brightness and improves the display uniformity.

It should be noted that FIG. 2, FIG. 6 and FIG. 10 exemplarily show that the voltage stabilizing storage device 20 includes two voltage stabilizing storage sub-devices 21, and one of the voltage stabilizing storage sub-devices 21 includes the switch device 211; FIG. 5 and FIG. 8 show that the voltage stabilizing storage device 20 includes two voltage stabilizing storage sub-devices 21, and each voltage stabilizing storage sub-device 21 includes the switch device 211; FIG. 3 and FIG. 9 show that the voltage stabilizing storage device 20 includes three voltage stabilizing storage sub-devices 21, each of the voltage stabilizing storage sub-devices 21 includes the switch device 211, but it is not intended to limit to this application. Some embodiments may configure the number of voltage stabilizing storage sub-devices 21 and the number of voltage stabilizing storage sub-devices 21 including the switch device 211 in the voltage stabilizing storage device 20 according to the actual situation.

Based on the above inventive concept, an embodiment of the present disclosure further provides a pixel driving method, which is applied to a pixel driving circuit. The pixel driving circuit includes a data writing device 10, a voltage stabilizing storage device 20, a driving device 30 and a light-emitting component 40.

The data writing device 10 is configured for transmitting a data signal voltage.

The driving device 30 is configured for generating a driving current according to the data signal voltage transmitted by the data writing device 10.

The voltage stabilizing storage device 20 is configured for storing the data signal voltage transmitted to the driving device 30.

The light-emitting component 40 is configured for emitting light in response to the driving current generated by the driving device 30.

The voltage stabilizing storage device 20 includes at least two voltage stabilizing storage sub-devices connected in parallel 21, each voltage stabilizing storage sub-device 21 includes a capacitor, at least one of the voltage stabilizing storage sub-devices 21 includes a switch device 211, and the switch device 211 is connected between the capacitor and the driving device 30.

Figure 11:
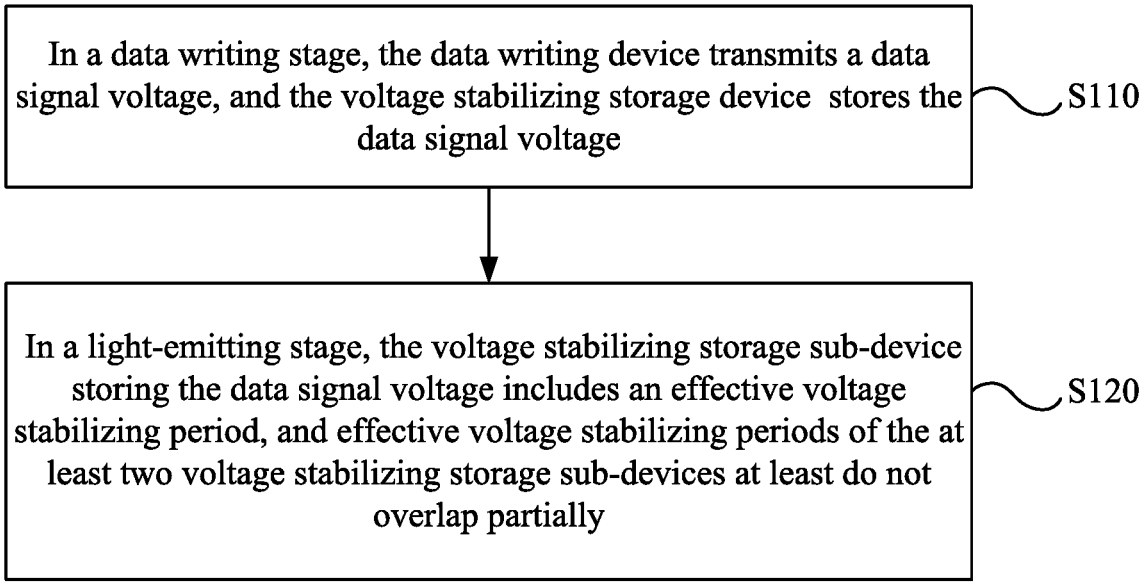
FIG. 11 is a flowchart of a pixel driving method provided by an embodiment of the present disclosure.

FIG. 11 is a flowchart of a pixel driving method provided by an embodiment of the present disclosure. Referring to FIG. 11, the pixel driving method includes steps described below.

In step S110, in a data writing stage, the data writing device 10 transmits a data signal voltage, and the voltage stabilizing storage device 20 stores the data signal voltage.

In step S120, in a light-emitting stage, the voltage stabilizing storage sub-device 21 storing the data signal voltage includes an effective voltage stabilizing period, and effective voltage stabilizing periods of the at least two voltage stabilizing storage sub-devices 21 at least do not overlap partially.

Within the effective voltage stabilizing period, the switch device 211 in the voltage stabilizing storage sub-device 21 is in a conductive state.

Figure 12:
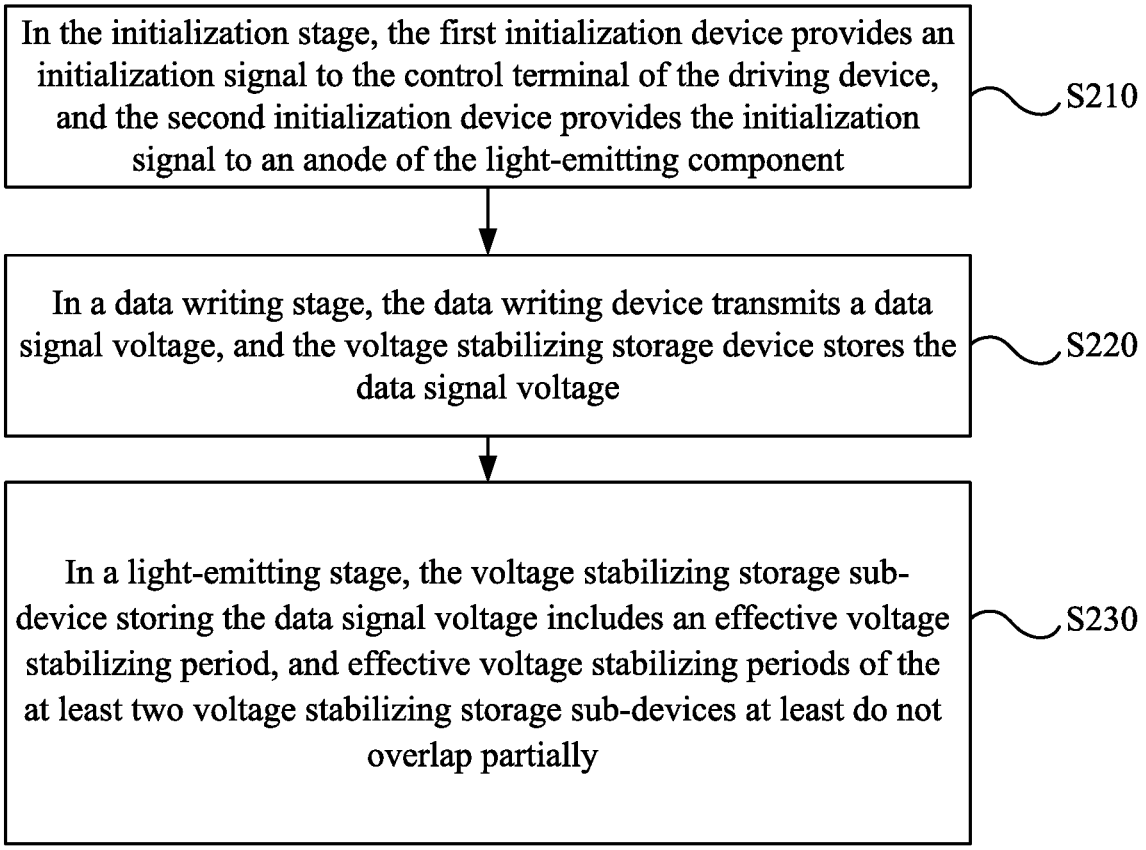
FIG. 12 is a flowchart of another pixel driving method provided by an embodiment of the present disclosure.

FIG. 12 is a flowchart of another pixel driving method provided by an embodiment of the present disclosure. When the pixel driving circuit includes the first initialization device 71 and the second initialization device 72, such as the pixel driving circuit shown in FIGS. 7 to 10, the pixel driving method further includes an initialization stage. In one embodiment of the present disclosure, in this case, the pixel driving method includes steps described below.

In step S210, in the initialization stage, the first initialization device 71 provides an initialization signal to the control terminal N of the driving device 30, and the second initialization device 72 provides the initialization signal to an anode of the light-emitting component 40.

In step S220, in a data writing stage, the data writing device 10 transmits a data signal voltage, and the voltage stabilizing storage device 20 stores the data signal voltage.

In step S230, in a light-emitting stage, the voltage stabilizing storage sub-device 21 storing the data signal voltage includes an effective voltage stabilizing period, and effective voltage stabilizing periods of the at least two voltage stabilizing storage sub-devices 21 at least do not overlap partially.

Within the effective voltage stabilizing period, the switch device 211 in the voltage stabilizing storage sub-device 21 is in a conductive state.

In one embodiment of the present disclosure, a union set of the time periods occupied by all effective voltage stabilizing periods overlaps with the light-emitting stage. It is ensured that at any time during the light-emitting stage, there is at least one capacitor for stabilizing the voltage of the control terminal N of the driving device 30, ensuring that the driving device 30 is able to generate a driving current throughout the light-emitting stage and drive the light-emitting component 40 to emit light.

In one embodiment of the present disclosure, the voltage stabilizing storage device storing the data signal voltage includes: when driving the pixel driving circuit at a first driving frequency, the voltage stabilizing storage device 20 storing the data signal voltage has a first capacitor, and when driving the pixel driving circuit at a second driving frequency, the voltage stabilizing storage device 20 storing the data signal voltage has a second capacitor, the first driving frequency is greater than the second driving frequency, and the first capacitor is smaller than the second capacitor.

In one embodiment of the present disclosure, if the first driving frequency is greater than the second driving frequency, and the first driving frequency and the second driving frequency belong to different frequency threshold ranges, the first capacitance is less than the second capacitance; if the second driving frequency is greater than the second driving frequency, and the first driving frequency and the second driving frequency belong to the same frequency threshold range, the first capacitance is equal to the second capacitance. The division of the frequency threshold may be configured according to the actual situation.

It can be understood that, with respect to each driving frequency, the voltage stabilizing storage device 20 storing the data signal voltage corresponds to a case where one capacitance is provided, by configuring the driving frequency belonging to the same frequency threshold range and the voltage stabilizing storage device 20 storing the data signal voltage corresponds to the same capacitance, the number of the voltage stabilizing storage sub-devices 21 in the voltage stabilizing storage device 20 may be reduced, and the structure of the voltage stabilizing storage device 20 may be simple.

It can be understood that the higher the driving frequency is, the shorter the time length of the pixel driving circuit in the data writing stage is, that is, the shorter a charging time of the capacitor in the voltage stabilizing storage device 20, the smaller the number of capacitors storing the data signal voltage should be, that is, a total capacitance of all capacitors configured for storing the data signal voltage should be as small as possible.

For ease of understanding "when the first driving frequency is greater than the second driving frequency, the first capacitance is smaller than the second capacitance", in combination with the pixel driving circuit shown in FIG. 9, a working process of the pixel driving circuit when the pixel driving circuit is driven at the first driving frequency and a working process of the pixel driving circuit when the pixel driving circuit is driven at the second driving frequency are shown, but it is not a limitation to the present application.

Figure 13:
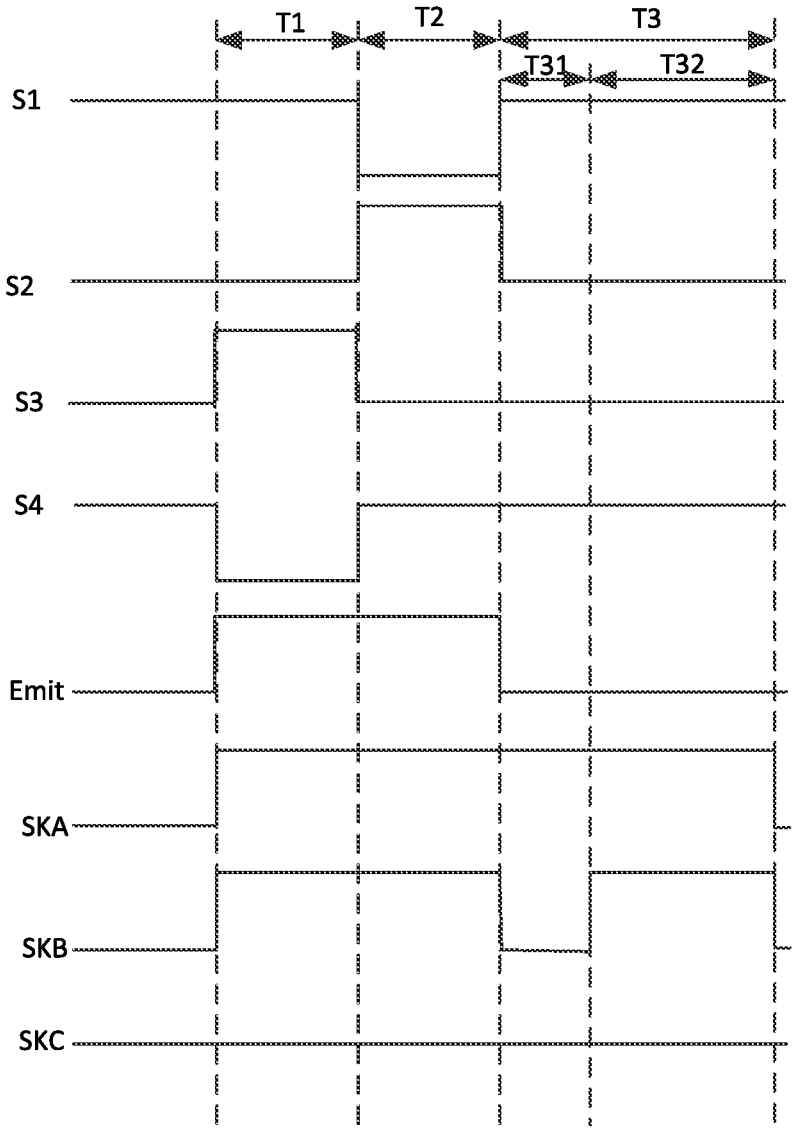
FIG. 13 is a driving timing graph of a pixel driving circuit provided by an embodiment of the present disclosure.
Figure 14:
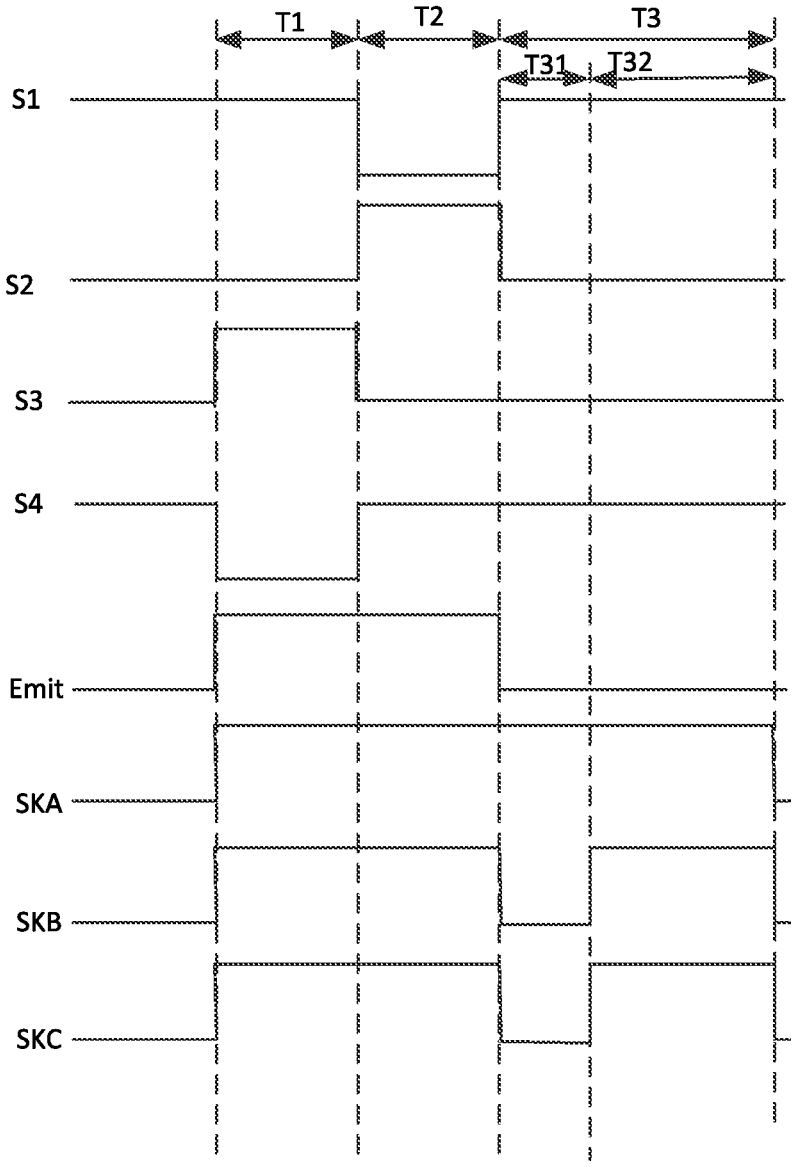
FIG. 14 is a driving timing graph of another pixel driving circuit provided by an embodiment of the present disclosure.

FIG. 13 is a driving timing graph of a pixel driving circuit provided by an embodiment of the present disclosure. FIG. 14 is a driving timing graph of another pixel driving circuit provided by an embodiment of the present disclosure. Exemplarily, the first driving frequency corresponding to the driving timing sequence shown in FIG. 13 is greater than the second driving frequency corresponding to the driving timing sequence shown in FIG. 14, that is, a total time length of a T1 stage, a T2 stage, and a T3 stage in FIG. 13 is less than a total time length of a T1 stage, a T2 stage, and a T3 stage in FIG. 14. Exemplarily, in the pixel driving circuit shown in FIG. 9, a first transistor M1A, a first transistor M1B, a first transistor M1C, a fourth transistor M4, and a seventh transistor M7 are N-type transistors, and a second transistor M2, a third transistor M3, a fifth transistor M5, a sixth transistor M6, and an eighth crystal are P-type transistors.

Referring to FIG. 13, when the pixel driving circuit is driven at the first driving frequency, the working process of the pixel driving circuit includes stages described below.

The T1 stage is the initialization stage. A third scanning signal provided by the third scanning signal terminal S3 is a logic high-level signal, and a fourth scanning signal provided by the fourth scanning signal terminal S4 is a logic low-level signal, so that the seventh transistor M7 and the eighth transistor M8 are turned on; a first switch signal provided by a switch signal terminal SKA and a second switch signal provided by a switch signal terminal SKB are both logic high-level signals, so that the first switch transistor M1A and the first switch transistor M1B are turned on. The first scanning signal provided by the first scanning signal terminal S1 is a logic high-level signal, the second scanning signal provided by the second scanning signal terminal S2 is a logic low-level signal, and a light emitting control signal provided by the light emitting control signal terminal Emit is logic high-level signal, so that the second transistor M2, the third transistor M3, the fourth transistor M4, the fifth transistor M5 and the sixth transistor M6 are all cut off a third switch signal provided by the switch signal terminal SKC is a logic low-level signal, a switch transistor M1C is cut off. An initialization signal of the initialization signal terminal Vref is written into a gate of the third transistor M3 (that is, the control terminal N of the driving device 30) through the turned-on seventh transistor M7, so that initialization is performed on a capacitor CA, a capacitor CB and the gate of the third transistor M3. The initialization signal provided by the initialization signal terminal Vref is a logic low-level signal to ensure that the third transistor M3 is able to be turned on in a next stage. The initialization signal of the initialization signal terminal Vref is also written into the anode of the light-emitting component 40 through the turned-on eighth transistor M8 to initialize an anode potential of the light-emitting component 40, reducing the influence of a voltage of the anode of the light-emitting component 40 of a previous frame on a voltage of the anode of the light-emitting component 40 of a succeeding frame, improving the display uniformity.

The T2 stage is the data writing stage. The first scanning signal provided by the first scanning signal terminal S1 is a logic low-level signal, and the second scanning signal provided by the second scanning signal terminal S2 is a logic high-level signal, so that the second transistor M2, the third transistor M3, and the fourth transistor M4 are all turned on; the first switch signal provided by the switch signal terminal SKA and the second switch signal provided by the switch signal terminal SKB are logic high-level signals, so that the first switch transistor M1A and the first switch transistor M1B are turned on. The third scanning signal provided by the third scanning signal terminal S3 is a logic low-level signal, the fourth scanning signal provided by the fourth scanning signal terminal S4 is a logic high-level signal, and a light emitting control signal provided by the light emitting control signal terminal Emit is logic high-level signal, so that the seventh transistor M7, the eighth transistor M8, the fifth transistor M5 and the sixth transistor M6 are all cut off, a third switch signal provided by the switch signal terminal SKC is a logic low-level signal, the switch transistor M1C is cut off. The data signal voltage of the data signal terminal Vdata is sequentially written into the gate of the third transistor M3 (i.e., the control terminal N of the driving device 30) and a second electrode of the capacitor CA (i.e., the plate where the capacitor CA is electrically connected to the driving device 30) and a second electrode of the capacitor CB (i.e., the plate where the capacitor CB is electrically connected to the driving device 30) through the turned-on second transistor M2, third transistor M3 and fourth transistor M4, so that a gate voltage of the third transistor M3 to gradually rise high until a voltage difference between the gate voltage of the third transistor M3 and the voltage of the first electrode of the third transistor M3 is equal to a threshold voltage Vth of the third transistor M3, that is, the gate voltage of the third transistor M3 $VN0=Vd-|Vth|$, where Vd is the data signal voltage provided by the data signal terminal Vdata; the gate voltage of the third transistor M3 is stored in the capacitor CA and capacitor CB.

The T3 stage is the light-emitting stage, and the light-emitting control signal provided by the light-emitting control signal terminal Emit is a logic low-level signal, so that both the fifth transistor M5 and the sixth transistor M6 are turned on. The first scanning signal provided by the first scanning signal terminal S1 is a logic high-level signal, the second scanning signal provided by the second scanning signal terminal S2 is a logic low-level signal, and the third scanning signal provided by the third scanning signal terminal S3 is logic low-level signal and the fourth scanning signal provided by the fourth scanning signal terminal S4 are logic high-level signals, so that the second transistor M2, the fourth transistor M4, the seventh transistor M7, and the eighth transistor M8 are all cut off. A power signal voltage $V_{pvdd}$ of a first power signal terminal PVDD is written into the first electrode of the third transistor M3 through the turned-on fifth transistor M5. In this case, a voltage difference between the first electrode T1 of the third transistor and a gate of the driving transistor T is Vsg=Vpvdd−Vd+|Vth|, the third transistor M3 generates a driving current, the driving current flows into the light emitting component 40 through the sixth transistor M6, and drives the light emitting component 40 to emit light. The driving current Id is:

$$\begin{aligned} I_d = & \frac{1}{2}\mu C_{ox}\frac{W}{L}(V_{sg}-|V_{th}|)^2 = \\ & \frac{1}{2}\mu C_{ox}\frac{W}{L}(V_{pvdd}-V_d+|V_{th}|+|V_{th}|)^2 \\ = & \frac{1}{2}\mu C_{ox}\frac{W}{L}(V_{prdd}-V_d)^2 \end{aligned}$$

μ is a carrier mobility, $C_{ox}$ is a channel capacitance per device of the third transistor M3, and $$\frac{W}{L}$$

is a width-to-length ratio of the third transistor M3. It can be seen that the driving current Id generated by the third transistor M3 is irrelevant to the threshold voltage Vth of the third transistor M3. The threshold voltage compensation of the third transistor M3 is implemented, and a display abnormality problem caused by the threshold voltage drift of the third transistor M3 is solved.

In one embodiment of the present disclosure, the T3 stage includes a T31 stage and a T32 stage. At the T31 stage, i.e., the first light-emitting stage, the first switch signal provided by the switch control signal terminal SKA is a logic high-level signal, so that the first transistor M1A is turned on, and the capacitor CA and the gate of the third transistor M3 are in a connected state, the capacitor CA is configured for stabilizing the gate voltage of the third transistor M3, and the second switch signal provided by the switch signal terminal SKB and the third switch signal provided by the switch signal terminal SKC are both logic low-level signals, so that both the first transistor M1B and the first transistor M1C are cut off, the capacitor CB and the capacitor CC are both in a disconnected state, potentials on both plates of the capacitor CB do not change. And the capacitor CB is not leaked. In the T32 stage, i.e., the second light-emitting stage, the first switch signal provided by the switch control signal terminal SKA and the second switch signal provided by the switch signal terminal SKB are both logic high-level signals, so that both the first transistor M1A and the first transistor M1B are turned on, the capacitor CA and the capacitor CB are both in connected to the gate of the third transistor M3, and both the capacitor CA and the capacitor CB are configured for stabilizing the gate voltage of the third transistor M3. The third switch signal provided by the switch signal terminal SKC is a logic low-level signal, so that the first transistor M1C is cut off, and the capacitor CC and the gate of the third transistor M3 are in the disconnected state. Thus when the pixel driving circuit is driven at the first driving frequency, the effective voltage stabilizing period of the voltage stabilizing storage sub-device 21A includes the T31 stage and the T32 stage, and the effective voltage stabilizing period of the voltage stabilizing storage sub-device 21B includes the T32 stage. In the entire process of the pixel driving circuit, the capacitor CC has been in an idle state, and the voltage stabilizing storage sub-device 21C does not include the effective voltage stabilizing period.

Referring to FIG. 14, when the pixel driving circuit is driven at the second driving frequency, the working process of the pixel driving circuit includes stages described below.

The T1 stage is the initialization stage. A third scanning signal provided by the third scanning signal terminal S3 is a logic high-level signal, and a fourth scanning signal provided by the fourth scanning signal terminal S4 is a logic low-level signal, so that the seventh transistor M7 and the eighth transistor M8 are turned on; a first switch signal provided by a switch signal terminal SKA, a second switch signal provided by a switch signal terminal SKB, and a third switch signal provided by a switch signal terminal SKC are logic high-level signals, so that the first switch transistor M1A, the first switch transistor M1C and the switch transistor M1C are turned on. The first scanning signal provided by the first scanning signal terminal S1 is a logic high-level signal, the second scanning signal provided by the second scanning signal terminal S2 is a logic low-level signal, and the light emitting control signal provided by the light emitting control signal terminal Emit is a logic high-level signal, so that the second transistor M2, the third transistor M3, the fourth transistor M4, the fifth transistor M5 and the sixth transistor M6 are all cut off; the initialization signal of the initialization signal terminal Vref is written into the gate (i.e., the control terminal N of the driving device 30) of the third transistor M3 through the turned-on seventh transistor M7 to perform initialization on the capacitor CA, the capacitor CB, the capacitor CC, and the gate of the third transistor M3. The initialization signal provided by the initialization signal terminal Vref is a logic low-level signal to ensure that the third transistor M3 is able to be turned on in the next stage.

The T2 stage is the data writing stage. The first scanning signal provided by the first scanning signal terminal S1 is a logic low-level signal, and the second scanning signal provided by the second scanning signal terminal S2 is a logic high-level signal, so that the second transistor M2, the third transistor M3, and the fourth transistor M4 are all turned on; the first switch signal provided by the switch signal terminal SKA, the second switch signal provided by the switch signal terminal SKB, a third switch signal provided by a switch signal terminal SKC are logic high-level signals are logic high-level signals, so that the first switch transistor M1A, the first switch transistor M1B and the switch transistor M1C is turned on. The third scanning signal provided by the third scanning signal terminal S3 is a logic low-level signal, the fourth scanning signal provided by the fourth scanning signal terminal S4 is a logic high-level signal, and a light emitting control signal provided by the light emitting control signal terminal Emit is logic high-level signal, so that the seventh transistor M7, the eighth transistor M8, the fifth transistor M5 and the sixth transistor M6 are all cut off. The data signal voltage of the data signal terminal Vdata is sequentially written into the gate of the third transistor M3 (i.e., the control terminal N of the driving device 30) and a second electrode of the capacitor CA (i.e., the plate where the capacitor CA is electrically connected to the driving device 30) and a second electrode of the capacitor CB (i.e., the plate where the capacitor CB is electrically connected to the driving device 30), and a second electrode of the capacitor CC (i.e., the plate where the capacitor CC is electrically connected to the driving device 30) through the turned-on second transistor M2, third transistor M3 and fourth transistor M4, so that a gate voltage of the third transistor M3 to gradually rise high until a voltage difference between the gate voltage of the third transistor M3 and the voltage of the first electrode of the third transistor M3 is equal to a threshold voltage Vth of the third transistor M3, that is, the gate voltage of the third transistor M3 VN0=Vd−|Vth|, where Vd is the data signal voltage provided by the data signal terminal Vdata; the gate voltage of the third transistor M3 is stored in the capacitor CA, the capacitor CB and the capacitor CC.

The T3 stage is the light-emitting stage, and the light-emitting control signal provided by the light-emitting control signal terminal Emit is a logic low-level signal, so that both the fifth transistor M5 and the sixth transistor M6 are turned on. The first scanning signal provided by the first scanning signal terminal S1 is a logic high-level signal, the second scanning signal provided by the second scanning signal terminal S2 is a logic low-level signal, and the third scanning signal provided by the third scanning signal terminal S3 is logic low-level signal and the fourth scanning signal provided by the fourth scanning signal terminal S4 are logic high-level signals, so that the second transistor M2, the fourth transistor M4, the seventh transistor M7, and the eighth transistor M8 are all cut off. A power signal voltage $V_{pvdd}$ of a first power signal terminal PVDD is written into the first electrode of the third transistor M3 through the turned-on fifth transistor M5. In this case, a voltage difference between the first electrode T1 of the third transistor and a gate of the driving transistor T is Vsg=$V_{pvdd}$−Vd+|Vth|, the third transistor M3 generates a driving current, the driving current flows into the light emitting component 40 through the sixth transistor M6, and drives the light emitting component 40 to emit light. The driving current Id is:

$$I_d = \frac{1}{2}\mu C_{ox}\frac{W}{L}(V_{pvdd} - V_d)^2.$$

In one embodiment of the present disclosure, the T3 stage includes a T31 stage and a T32 stage. At the T31 stage, i.e., the first light-emitting stage, the first switch signal provided by the switch control signal terminal SKA is a logic high-level signal, so that the first transistor M1A is turned on, and the capacitor CA and the gate of the third transistor M3 are in a connected state, the capacitor CA is configured for stabilizing the gate voltage of the third transistor M3, and the second switch signal provided by the switch signal terminal SKB and the third switch signal provided by the switch signal terminal SKC are both logic low-level signals, so that both the first transistor M1B and the first transistor M1C are cut off, the capacitor CB and the capacitor CC are both in a disconnected state, potentials on both plates of the capacitor CB do not change, and the capacitor CB is not leaked. Similarly, the capacitor CC is not leaked. In the T32 stage, i.e., the second light-emitting stage, the first switch signal provided by the switch control signal terminal SKA, the second switch signal provided by the switch signal terminal SKB, the third switch signal provided by the switch signal terminal SKC are logic high-level signals, so that the first transistor M1A, the first transistor M1B and the first transistor M1C are turned on, the capacitor CA, the capacitor CB and the capacitor CC are in connected to the gate of the third transistor M3, and the capacitor CA and the capacitor CB, and the capacitor CC are configured for stabilizing the gate voltage of the third transistor M3.

Thus when the pixel driving circuit is driven at the second driving frequency, the effective voltage stabilizing period of the voltage stabilizing storage sub-device 21A includes the T31 stage and the T32 stage, the effective voltage stabilizing period of the voltage stabilizing storage sub-device 21B includes the T32 stage, and the effective voltage stabilizing period of the voltage stabilizing storage sub-device 21C includes the T32 stage.

It can be understood that, for pixel driving circuits with different structures of the voltage stabilizing storage device 20, "the specific implementation form in which the effective voltage stabilizing periods of at least two voltage stabilizing storage sub-devices 21 at least partially do not overlap" is generally different, and for the same pixel driving circuit, "the effective voltage stabilizing periods of at least two voltage stabilizing storage sub-devices 21 at least partially do not overlap" usually has a variety of specific implementation forms. In view of the limited space, the specific implementation forms are difficult to be listed. Therefore, in conjunction with FIG. 9, in the pixel driving circuit shown in FIG. 9, an example in which the first transistor M1A, the first transistor M1B, the first transistor M1C, the fourth transistor M4, and the seventh transistor M7 are N-type transistors, and the second transistor M2, the third transistor M3, the fifth transistor M5, the sixth transistor M6, and the eighth crystal are P-type transistors, and the pixel driving circuit is driven at the second driving frequency is taken. Several specific forms in which "the effective voltage stabilizing periods of at least two voltage stabilizing storage sub-devices 21 at least partially do not overlap" are exemplarily shown, which are not intended to limit the present application.

Figure 15:
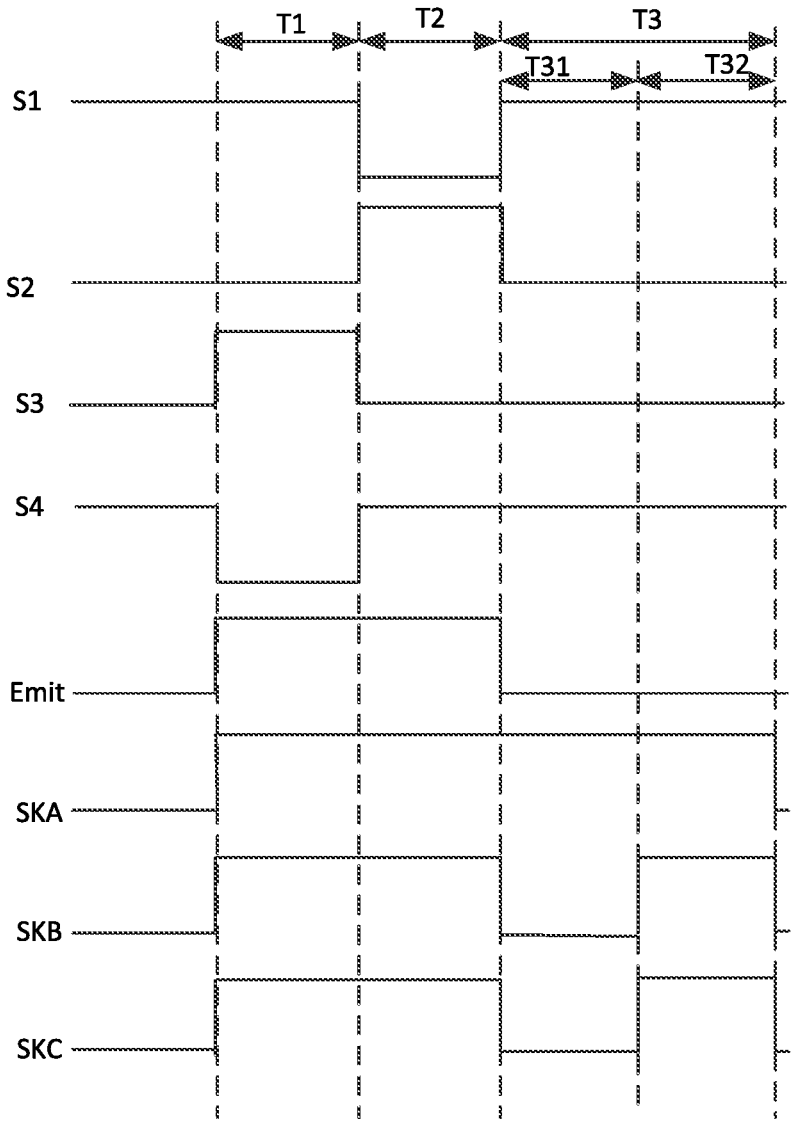
FIG. 15 is a driving timing graph of another pixel driving circuit provided by an embodiment of the present disclosure.

FIG. 15 is a driving timing graph of another pixel driving circuit provided by an embodiment of the present disclosure. Referring to FIG. 15, in one embodiment of the present disclosure, starting occasions of the effective voltage stabilizing period of at least two voltage stabilizing storage sub-devices 21 are different. It is beneficial to reduce a voltage change amount $\Delta V_N$ of the control terminal N of the driving device 30 at the light emitting stage, where $\Delta V_N = V_{Nmax} - V_{N0}$", $V_{N0}$ is the voltage of the control terminal N of the driving device 30 at the initialization occasion at the light-emitting stage, and $V_{Nmax}$ is a maximum voltage of the control terminal N of the driving device 30 at the light emitting stage.

Figure 16:
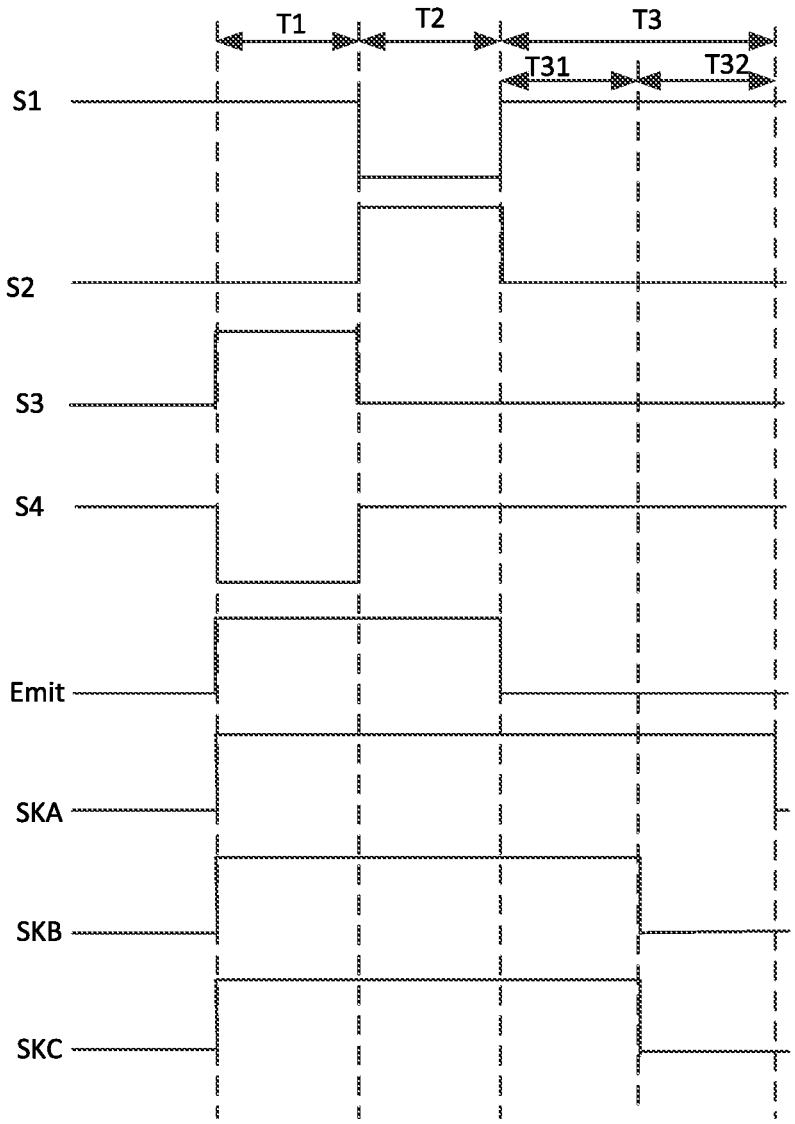
FIG. 16 is a driving timing graph of another pixel driving circuit provided by an embodiment of the present disclosure.

To explain this beneficial effect in detail, the beneficial effect is explained below by comparing with a comparative example. FIG. 16 is a driving timing graph of another pixel driving circuit provided by an embodiment of the present disclosure. In FIGS. 15 and 16, a time length of the T31 stage is equal to a time length of the T32 phase. The difference between the driving timing graph shown in FIG. 15 and the driving timing diagram shown in FIG. 16 is that, in FIG. 15, starting occasions of the effective voltage stabilizing periods of the voltage stabilizing storage sub-device 21B and the voltage stabilizing storage sub-device 21C are different from a starting occasion of the effective voltage stabilizing period of the voltage stabilizing storage sub-device 21A; in FIG. 16, the starting occasions of the effective voltage stabilization periods of the voltage stabilizing storage sub-device 21A, the voltage stabilizing storage sub-device 21B and the voltage stabilizing storage sub-device 21C.

For the driving timing sequence shown in FIG. 15, at the T31 stage, the capacitor CA is configured for stabilizing the voltage of the control terminal of the driving device 30. At an end occasion of the T31 stage, the voltage of the control terminal N of the driving device 30 is raised to:

$$V_{N1} = V_{N0} + \frac{\Delta Q \times \frac{t_1}{t_1 + t_2}}{c_A}.$$

In the T32 stage, the capacitor CA, the capacitor CB, and the capacitor CC are used together for stabilizing the voltage of the control terminal of the driving device 30. At the starting occasion of the T32 phase, the voltage of the control terminal N of the driving device 30 is pulled down as:

$$V_{N20} = V_{N0} + \frac{\Delta Q \times \frac{t_1}{t_1 + t_2}}{c_{A+}c_{B+}c_C}.$$

At the end occasion of the T32 stage, the voltage of the control terminal N of the driving device 30 is raised to:

$$V_{N2} = V_{N0} + \frac{\Delta Q \times \frac{t_1}{t_1 + t_2}}{c_{A+}c_{B+}c_C} + \frac{\Delta Q \times \frac{t_2}{t_1 + t_2}}{c_{A+}c_{B+}c_C}.$$

Then the voltage change amount is:

$$\Delta V_N = \frac{\Delta Q \times \frac{t_1}{t_1 + t_2}}{c_{A+}c_{B+}c_C} + \frac{\Delta Q \times \frac{t_2}{t_1 + t_2}}{c_{A+}c_{B+}c_C}.$$

Where $V_{N0}$ is the voltage (i.e., the data signal voltage) of the control terminal of the driving device 30 at the starting occasion of the light-emitting stage (i.e., the starting occasion of the first light-emitting stage), ΔQ is total leakage charges of the voltage stabilizing storage device 20 at the light-emitting stage, $t_1$ is the time length of the T31 stage, $t_2$ is the time length of the T32 stage, $c_A$ is a capacitance of the capacitor CA, $c_B$ is a capacitance of the capacitor CB, $c_C$ is a capacitance of the capacitor CC.

For the driving timing sequence shown in FIG. 16, at the T31 stage, the capacitor CA, the capacitor CB and the capacitor CC is configured for stabilizing the voltage of the control terminal of the driving device 30. At the end occasion of the T31 stage and the starting occasion of the T32 stage, the voltage of the control terminal N of the driving device 30 is raised to:

$$V_{N1} = V_{N0} + \frac{\Delta Q \times \frac{t_1}{t_1 + t_2}}{c_{A+}c_{B+}c_C}.$$

In the T32 stage, the capacitor CA is configured for stabilizing the voltage of the control terminal of the driving device 30. At an end occasion of the T32 stage, the voltage of the control terminal N of the driving device 30 is raised to:

$$V_{N2} = V_{N0} + \frac{\Delta Q \times \frac{t_1}{t_1 + t_2}}{c_{A+}c_{B+}c_C} + \frac{\Delta Q \times \frac{t_2}{t_1 + t_2}}{c_A}.$$

Then the voltage change amount is:

$$\Delta V_N + \frac{\Delta Q \times \frac{t_1}{t_1 + t_2}}{c_{A+}c_{B+}c_C} + \frac{\Delta Q \times \frac{t_2}{t_1 + t_2}}{c_A}.$$

It can be seen that through configuring the starting occasions of the effective voltage stabilizing periods of the at least two voltage stabilizing storage sub-devices 21 to be different, the raised voltage of the control terminal N of the driving device 30 may be pulled down first at an occasion where capacitors (such as the capacitor CB and the capacitor CC corresponding to FIG. 15) connected later are connected to the control terminal N of the driving device 30, and the voltage of the control terminal N of the driving device 30 may be pulled down once when a new capacitor is connected each time. Therefore, it is beneficial to reduce the voltage change amount of the voltage of the control terminal N of the driving device 30 at the light-emitting stage.

Figure 17:
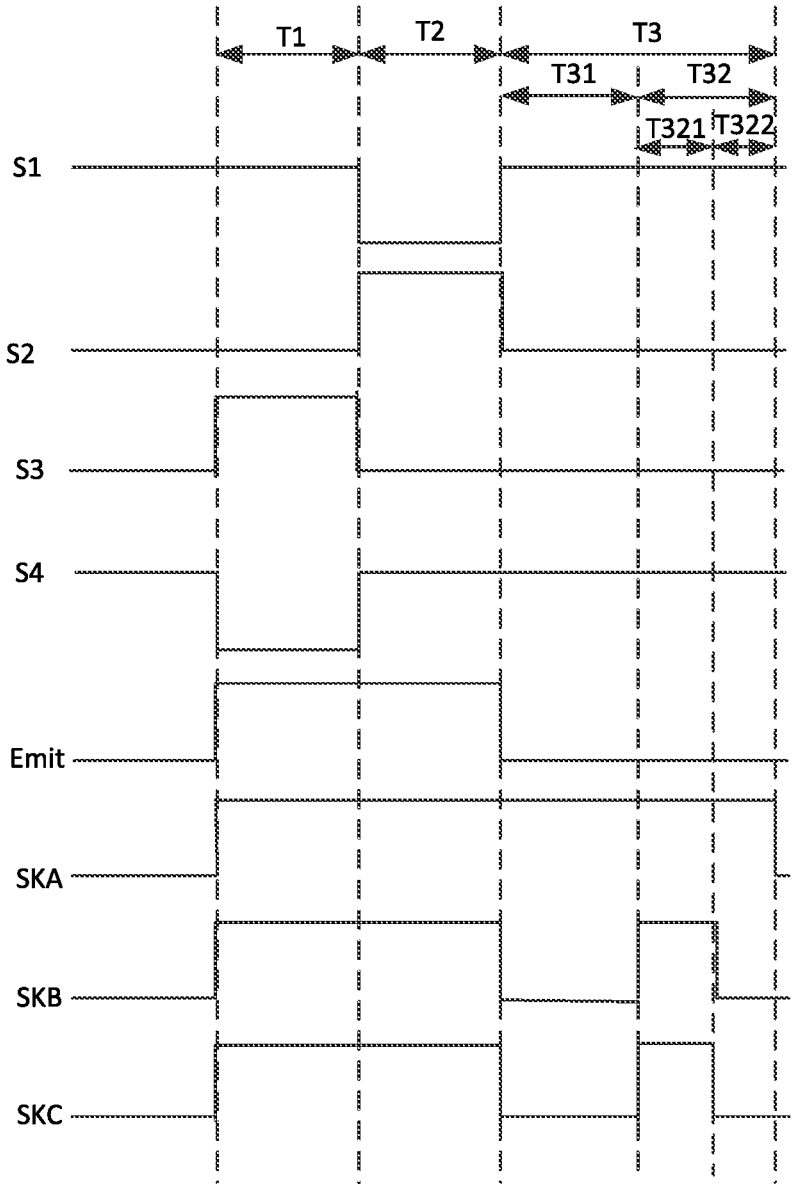
FIG. 17 is a driving timing graph of a pixel driving circuit provided by an embodiment of the present disclosure.

Referring to FIG. 15, in one embodiment of the present disclosure, the end occasion of the effective voltage stabilizing period of each voltage stabilizing storage sub-device 21 is the same as the end occasion of the light-emitting stage. It may further reduce the voltage change amount $\Delta V_N$ of the voltage of the control terminal N of the driving device 30 at the light-emitting stage, and improve the display uniformity. To explain this beneficial effect in detail, the beneficial effect is explained below by comparing with a comparative example. FIG. 17 is a driving timing graph of a pixel driving circuit provided by an embodiment of the present disclosure. In FIGS. 15 and 17, the time length of the T31 phase is equal to the time length of the T32 phase. The difference between the driving timing diagram shown in FIG. 15 and the driving timing diagram shown in FIG. 17 is that the end occasion of the effective voltage stabilizing periods of the voltage stabilizing storage sub-device 21A, the voltage stabilizing storage sub-device 21B and the voltage stabilizing storage sub-device 21C are the same as the end occasion of the light-emitting stage. In FIG. 17, the end occasion of the effective voltage stabilizing periods of the voltage stabilizing storage sub-device 21B and the voltage stabilizing storage sub-device 21C is earlier than the end occasion of the light-emitting stage.

For the driving timing sequence shown in FIG. 17, at the T31 stage, the capacitor CA is configured for stabilizing the voltage of the control terminal of the driving device 30. At an end occasion of the T31 stage, the voltage of the control terminal N of the driving device 30 is raised to:

$$V_{N1} = V_{N0} + \frac{\Delta Q \times \frac{t_1}{t_1 + t_{21} + t_{22}}}{c_A}.$$

In a T321 stage, the capacitor CA, the capacitor CB, and the capacitor CC are used together for stabilizing the voltage of the control terminal of the driving device 30. At the starting occasion of a T321 phase, the voltage of the control terminal N of the driving device 30 is pulled down as:

$$V_{N20} = V_{N0} + \frac{\Delta Q \times \frac{t_1}{t_1 + t_{21} + t_{22}}}{c_{A+}c_{B+}c_C}.$$

At an end occasion of the T321 stage, the voltage of the control terminal N of the driving device 30 is raised to:

$$V_{N21} = V_{N0} + \frac{\Delta Q \times \frac{t_1}{t_1 + t_{21} + t_{22}}}{c_A} + \frac{\Delta Q \times \frac{t_2}{t_1 + t_{21} + t_{22}}}{c_{A+}c_{B+}c_C}.$$

In the T322 stage, the capacitor CA is configured for stabilizing the voltage of the control terminal of the driving device 30. At an end occasion of the T322 stage, the voltage of the control terminal N of the driving device 30 is raised to:

$$V_{N2} = V_{N0} + \frac{\Delta Q \times \frac{t_1}{t_1 + t_{21} + t_{22}}}{c_A} + \frac{\Delta Q \times \frac{t_2}{t_1 + t_{21} + t_{22}}}{c_{A+}c_{B+}c_C} + \frac{\Delta Q \times \frac{t_3}{t_1 + t_{21} + t_{22}}}{c_A}.$$

Then the voltage change amount is:

$$\Delta V_N = \frac{\Delta Q \times \frac{t_1}{t_1 + t_{21} + t_{22}}}{c_A} + \frac{\Delta Q \times \frac{t_2}{t_1 + t_{21} + t_{22}}}{c_{A+}c_{B+}c_C} + \frac{\Delta Q \times \frac{t_3}{t_1 + t_{21} + t_{22}}}{c_A},$$

and $t_1$ is a time length of the first light-emitting stage, $t_{21}$ is a time length of the T321 stage, $t_{22}$ is a time length of the T322 stage.

It can be seen that through configuring the end occasion of the effective voltage stabilizing period of each voltage stabilizing storage sub-device 21 to be the same as the end occasion of the light-emitting stage, the leaked charge amount shared by the capacitor in each voltage stabilizing storage sub-device 21 may be almost same for avoiding a total leaked charge amount of the voltage stabilizing storage device 20 is concentrated on the capacitance of a certain voltage stabilizing storage sub-device 21, so it is beneficial to evenly distribute the total leaked charge amount of the entire voltage stabilizing storage device 20 to each voltage stabilizing storage sub-device 21, further reducing the voltage change amount of the voltage of the control terminal N of the driving device 30 at the light-emitting stage, and improve the display uniformity.

Figure 18:
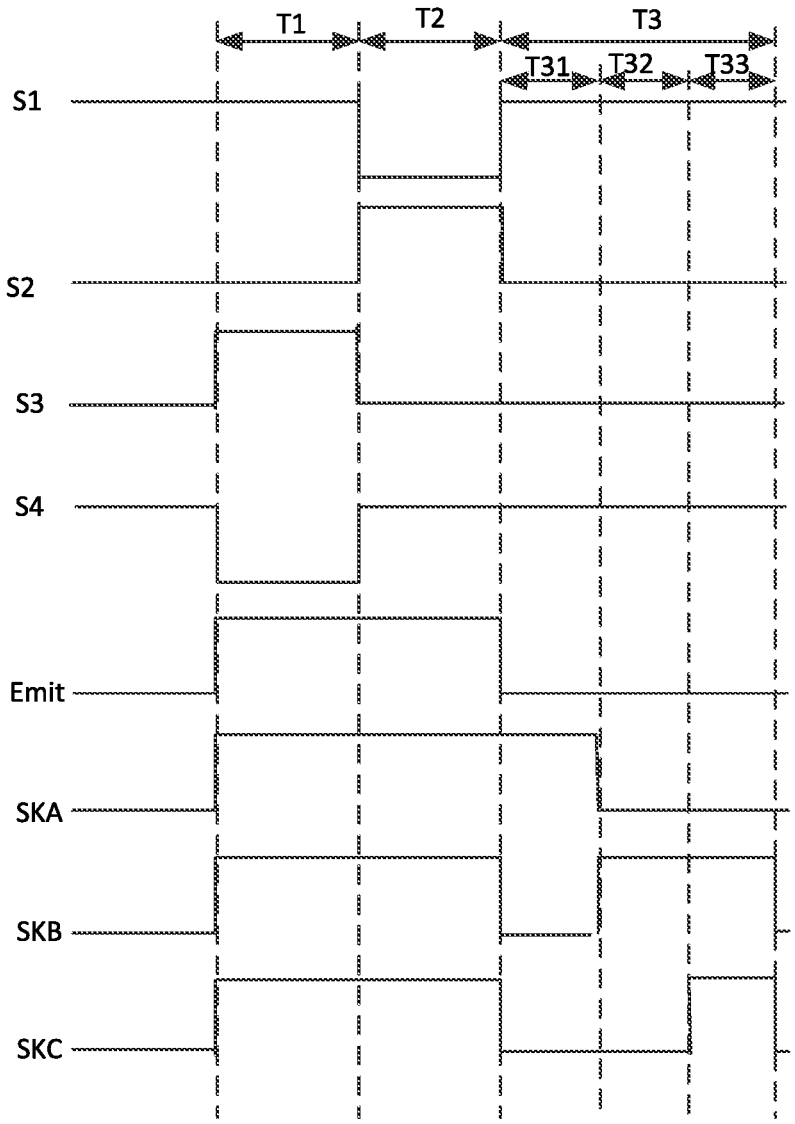
FIG. 18 is a driving timing graph of another pixel driving circuit provided by an embodiment of the present disclosure.

FIG. 18 is a driving timing graph of another pixel driving circuit provided by an embodiment of the present disclosure. In one embodiment of the present disclosure, the starting occasion of the effective voltage stabilizing period of each voltage stabilizing storage sub-device 21 is different, and the time length of the non-overlapping part of any two effective voltage stabilizing periods with adjacent starting occasions is the same. Exemplarily, the time length of the T31 stage is equal to the time length of the T32 stage.

In one embodiment, the time length of the non-overlapping part of any two effective voltage stabilizing periods with adjacent starting occasions may be configured according to the actual situation, which is not limited here.

In this way, the problem that the time length of the effective voltage stabilizing stage of some voltage stabilizing storage sub-devices 21 is short and the leaked charge amount shared by them may be avoided in order to further ensure that the total leaked charge amount of the entire voltage stabilizing storage device 20 may be evenly distributed on the capacitor in each voltage stabilizing storage sub-device 21, which is beneficial to reduce the voltage change amount of the voltage of the control terminal N of the driving device 30 at the light-emitting stage and improve the display uniformity.

Figure 19:
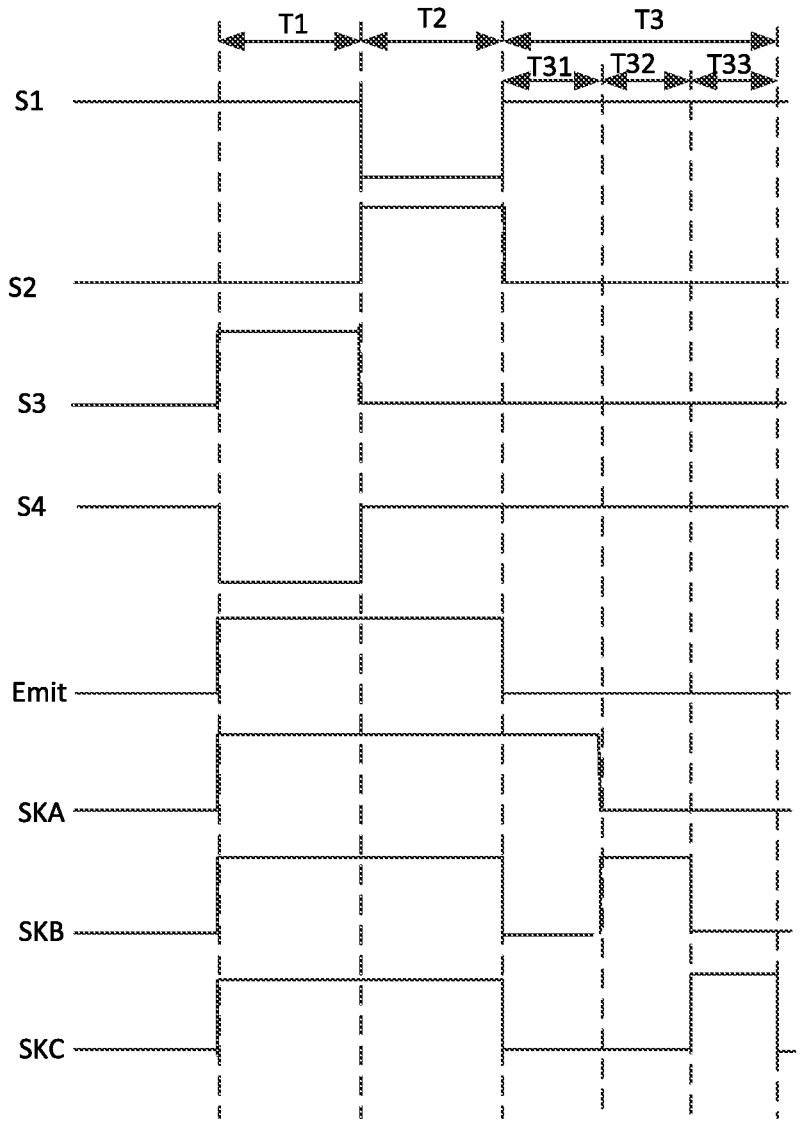
FIG. 19 is a driving timing graph of another pixel driving circuit provided by an embodiment of the present disclosure.

FIG. 19 is a driving timing graph of another pixel driving circuit provided by an embodiment of the present disclosure. In one embodiment of the present disclosure, the effective voltage stabilizing stages of any two voltage stabilizing storage sub-devices 21 do not overlap.

For the driving timing sequence shown in FIG. 19, at the T31 stage, the capacitor CA is configured for stabilizing the voltage of the control terminal of the driving device 30. At an end occasion of the T31 stage, the voltage of the control terminal N of the driving device 30 is raised to:

$$V_{N1} = V_{N0} + \frac{\frac{\Delta Q}{3}}{c_A}.$$

In the T32 stage, the capacitor CB is configured for stabilizing the voltage of the control terminal of the driving device 30. At the starting occasion of the T32 stage, the voltage of the control terminal N of the driving device 30 is pulled down as $V_{N0}$.

At the end occasion of the T32 stage, the voltage of the control terminal N of the driving device 30 is raised to $$V_{N2} = V_{N0} + \frac{\frac{\Delta Q}{3}}{c_B}:.$$

In the T33 stage, the capacitor CC is configured for stabilizing the voltage of the control terminal of the driving device 30. At the starting occasion of the T33 stage, the voltage of the control terminal N of the driving device 30 is pulled down as $V_{N0}$.

At an end occasion of the T33 stage, the voltage of the control terminal N of the driving device 30 is raised to:

$$V_{N3} = V_{N0} + \frac{\frac{\Delta Q}{3}}{c_C}.$$

The voltage change amount is a maximum among $$\frac{\frac{\Delta Q}{3}}{c_A}, \frac{\frac{\Delta Q}{3}}{c_B} \text{ and } \frac{\frac{\Delta Q}{3}}{c_C}.$$

It can be seen that through configuring the effective voltage stabilizing stages of any two voltage stabilizing storage sub-devices 21 to be not overlapped, each time the voltage stabilizing storage sub-device 21 is switched, the voltage of the control terminal N of the driving device 30 may be pulled to the initialization occasion of the light-emitting phase, in this way, it is beneficial to reduce the voltage change amount of the voltage of the control terminal N of the driving device 30 at the light-emitting stage, and improve the display uniformity.

Referring to FIG. 19, In one embodiment of the present disclosure, the time length of the effective voltage stabilizing stage of each voltage stabilizing storage sub-device 21 is equal.

It can be understood that, when the capacitances of the various voltage stabilizing storage sub-devices 21 are the same, through configuring the time length of the effective voltage stabilizing stage of each voltage stabilizing storage sub-device 21 to be equal, the total leaked charge of the entire voltage stabilizing storage device 20 may be evenly distributed to the capacitor in each voltage stabilizing storage sub-device 21, which is beneficial to reduce the voltage change amount of the voltage of the control terminal N of the driving device 30 at the light-emitting stage, and improve the display uniformity.

In view of the limited space, it is impossible to compare the driving method in this application with the related driving methods. Therefore, the following will exemplarily compare the driving method shown in FIG. 19 with the related driving methods to illustrate that the driving method in this application is able to improve the display unevenness caused by capacitor leakage. To eliminate the influence of other devices of the pixel driving circuit on the leakage of the voltage stabilizing storage device, only the influence of the driving method on the leakage of the voltage stabilizing storage device is considered. It is assumed that the difference between the pixel driving circuit driven by driving method shown in FIG. 19 and the pixel driving circuit driven by the related driving method is that the voltage stabilizing storage device of the pixel driving circuit driven by the related driving method only includes a capacitor, one plate of the capacitor is directly connected to the first power signal terminal through a wire, and the other plate of the capacitor is connected to the control terminal of the driving device is directly connected through the wire, and the capacitance of the capacitor is CA.

In the related driving method, a capacitor is configured for stabilizing the voltage of the control terminal of the control device at the entire light-emitting stage. Therefore, at the end occasion of the light-emitting stage, the voltage of the control terminal of the driving device is raised to:

$$V_N' = V_{N0} + \frac{\Delta Q}{c_A}\Big|.$$

Then the voltage change amount is:

$$\frac{\Delta Q}{c_A}.$$

Figure 20:
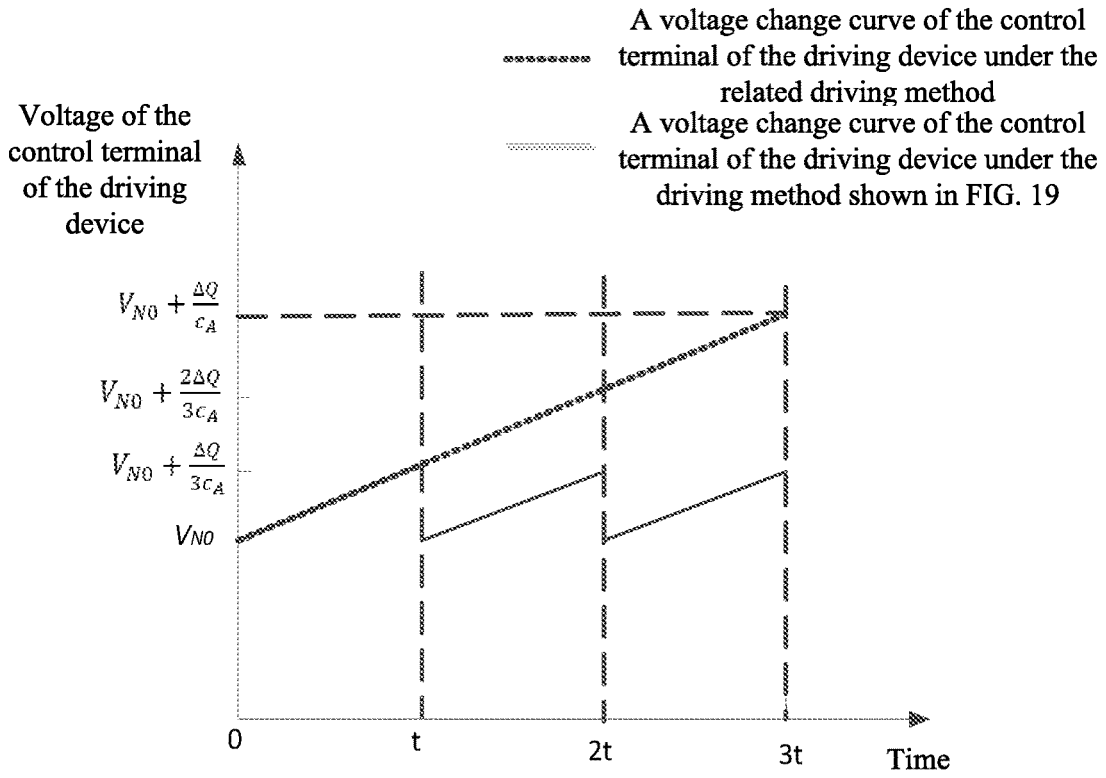
FIG. 20 is a diagram illustrating a voltage variation of a control terminal of a driving device provided by an embodiment of the present disclosure.

Exemplarily, FIG. 20 is a diagram illustrating a voltage variation of a control terminal of a driving device provided by an embodiment of the present disclosure. The solid line indicates a voltage change curve of the control terminal of the driving device under the driving method shown in FIG. 19 when $C_A=C_B=C_C$, the dotted line indicates a voltage change curve of the control terminal of the driving device under the related driving method, the abscissa is time, and 0 indicates the starting occasion of the light-emitting stage, t indicates the end occasion of the T31 stage, 2t indicates the end occasion of the T32 stage, and 3t indicates the end occasion of the T33 stage. It can be seen that, compared with the related driving method, the driving method shown in FIG. 19 may enable the voltage of the control terminal of the driving device to be more stable, and the change amount is smaller, that is, it is able to improve the display unevenness caused by the capacitor leakage.

It should be noted that FIGS. 13 to 19 are only driving timing graphs when the second transistor M2, the third transistor M3, the fifth transistor M5, the sixth transistor M6, and the eighth transistor M8 in the pixel driving circuit are P-type transistors, generally the P-type transistors are turned on under the control of the logic low-level signal, and cut off under the control of the logic high-level signal. In some embodiments, the second transistor M2, the third transistor M3, the fifth transistor M5, the sixth transistor M6, and the eighth transistor M8 in the pixel driving circuit are P-type transistors or N-type transistors, generally the N-type transistors are turned on under the control of the logic high-level signal and cut off under the control of the logic low-level signal. The embodiment of the present disclosure does not specifically limit that the second transistor M2, the third transistor M3, the fifth transistor M5, the sixth transistor M6, and the eighth transistor M8 in the pixel driving circuit are the P-type transistors.

Based on the above inventive concept, a display panel is provided according to an embodiment of the present disclosure. The display panel includes the pixel driving circuit according to any embodiment of the present disclosure. Therefore, the display panel has the beneficial effect of the pixel driving circuit provided by the embodiment of the present disclosure, and similarities may be understood with reference to the above and will not be described in detail below.

Figure 21:
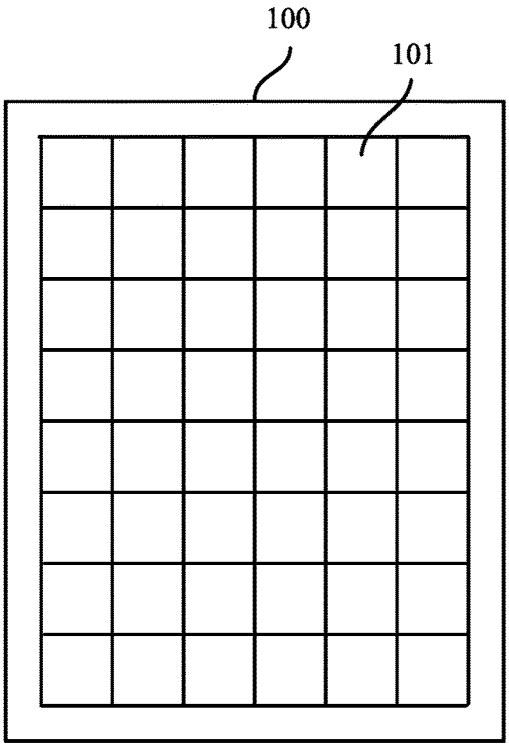
FIG. 21 is a structural diagram of a display panel provided by an embodiment of the present disclosure.
Figure 22:
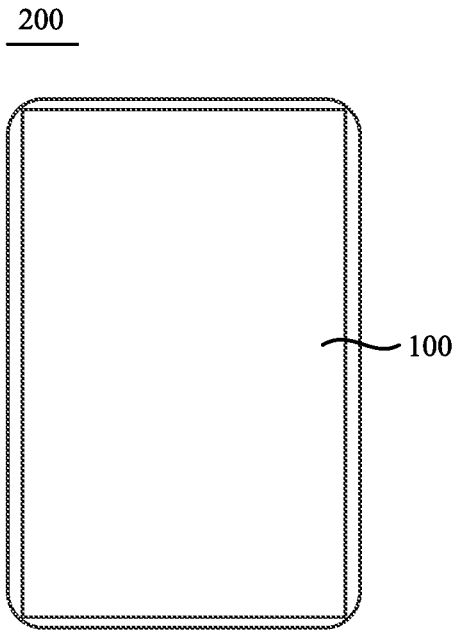
FIG. 22 is a schematic view showing a structure of a display apparatus provided by an embodiment of the present disclosure.

Exemplarily, FIG. 21 is a structural diagram of a display panel provided by an embodiment of the present disclosure. As shown in FIG. 21, a display panel 100 includes multiple pixels 101 arranged in an array, and each pixel 101 includes a pixel driving circuit provided by the embodiment of the present disclosure. The pixel driving circuit is able to drive a light emitting component to emit light, so that the display panel 100 is able to display the corresponding picture.

Based on the above inventive concept, an embodiment of the present disclosure further provides a display device including the display panel described in any one of embodiments of the present disclosure.

Exemplarily, FIG. 21 is a structural diagram of a display device provided by an embodiment of the present disclosure. As shown in FIG. 21, the display device 200 provided by the embodiment of the present disclosure includes the display panel 100 provided by the embodiment of the present disclosure. The display device 200 may be, for example, any electronic device with a display function such as a touch screen, a mobile phone, a tablet PC, a laptop, or a television.

What is claimed is:

1. A pixel driving circuit, comprising: a data writing device, a voltage stabilizing storage device, a driving device and a light-emitting component;

wherein the data writing device is configured for transmitting a data signal voltage;

the driving device is configured for generating a driving current according to the data signal voltage transmitted by the data writing device;

the voltage stabilizing storage device is configured for storing the data signal voltage transmitted to the driving device;

the light-emitting component is configured for emitting light in response to the driving current generated by the driving device;

wherein the voltage stabilizing storage device comprises at least two voltage stabilizing storage sub-devices connected in parallel, each voltage stabilizing storage sub-device of the at least two voltage stabilizing storage sub-devices comprises a capacitor and a switch device, and wherein in each voltage stabilizing storage sub-device the switch device is connected between the capacitor and the driving device;

wherein the voltage stabilizing storage device comprises a first voltage stabilizing storage sub-device and a second voltage stabilizing storage sub-device, and wherein the first voltage stabilizing storage sub-device comprises a first capacitor and a first transistor M1A, a first pole of the first capacitor is connected to a first power signal terminal, a second pole of the first capacitor is connected to a first electrode of the first transistor M1A, a second electrode of the first transistor M1A is connected to the driving device, and a gate of the first transistor M1A is connected to a switch control signal terminal SKA;

wherein the second stabilizing voltage storage sub-device comprises a second capacitor and a first transistor M1B, a first pole of the second capacitor is connected to a first power signal terminal, a second pole of the second capacitor is connected to a first electrode of the first transistor M1B, a second electrode of the first transistor M1B is connected to the driving device, and a gate of the first transistor M1B is connected to a switch control terminal SKB.

2. The pixel driving circuit of claim 1, wherein the switch device comprises a first transistor.

3. The pixel driving circuit of claim 1, wherein the capacitor in each voltage stabilizing storage sub-device has a same capacitance.

4. The pixel driving circuit of claim 1, wherein a capacitance of the first capacitor is greater than a capacitance of the second capacitor.

5. The pixel driving circuit of claim 1, wherein capacitors in the at least two voltage stabilizing storage sub-devices have different capacitances.

6. The pixel driving circuit of claim 1, wherein the data writing device is electrically connected to a scanning signal terminal, a data signal terminal and a control terminal of the driving device;

wherein the voltage stabilizing storage device is electrically connected between a first power signal terminal and the control terminal of the driving device, wherein the switch device is electrically connected to a switch control signal terminal;

wherein the driving device is electrically connected to the first power signal terminal and an anode of the light-emitting component, a cathode of the light-emitting component is electrically connected to a second power signal terminal.

7. The pixel driving circuit of claim 1, wherein the pixel driving circuit further comprises a threshold compensation device and a light-emitting control device, wherein the threshold compensation device is configured for compensating a threshold voltage of the driving device to a control terminal of the driving device;

wherein the light-emitting control device is configured for controlling the driving device to generate the driving current to flow into the light-emitting component;

wherein the data writing device is electrically connected to a first scanning signal terminal, a data signal terminal and a first terminal of the driving device, wherein the threshold compensation device is electrically connected to a second scanning signal terminal, a second terminal of the driving device and the control terminal of the driving device;

wherein the voltage stabilizing storage device is electrically connected between a first power signal terminal and the control terminal of the driving device, and the switch device is electrically connected to a switch control signal terminal;

wherein the light-emitting control device comprises a first light-emitting control device and a second light-emitting control device, the first light-emitting control device is electrically connected to a light-emitting control signal terminal, a first power signal terminal and a first terminal of the driving device; a second light-emitting control device is electrically connected to the light-emitting control signal terminal, a second terminal of the driving device and an anode of the light-emitting component; and a cathode of the light-emitting component is electrically connected to a second power signal terminal.

8. The pixel driving circuit of claim 7, wherein the pixel driving circuit further comprises a first voltage stabilizing capacitor, and wherein the first voltage stabilizing capacitor is electrically connected between the control terminal of the driving device and the second power signal terminal.

9. The pixel driving circuit of claim 1, wherein the pixel driving circuit further comprises a first initialization device and a second initialization device;

wherein the first initialization device is configured for providing an initialization signal for a control terminal of the driving device, the second initialization device is configured for providing the initialization signal to an anode of the light-emitting component;

wherein the first initialization device is electrically connected to a third scanning signal terminal, an initialization signal terminal and the control terminal of the driving device; and wherein the second initialization device is electrically connected to a fourth scanning signal terminal, the initialization signal terminal and the anode of the light-emitting component.

10. The pixel driving circuit of claim 9, wherein the pixel driving circuit further comprises a second voltage stabilizing capacitor, and the second voltage stabilizing capacitor is electrically connected between the control terminal of the driving device and the initialization signal terminal.

11. A driving method of a pixel driving circuit, applied to the pixel driving circuit, wherein the pixel driving circuit comprises a data writing device, a voltage stabilizing storage device, a driving device and a light-emitting component; wherein the data writing device is configured for transmitting a data signal voltage;

the driving device is configured for generating a driving current according to the data signal voltage transmitted by the data writing device;

the voltage stabilizing storage device is configured for storing the data signal voltage transmitted to the driving device;

the light-emitting component is configured for emitting light in response to the driving current generated by the driving device;

wherein the voltage stabilizing storage device comprises at least two voltage stabilizing storage sub-devices connected in parallel, each voltage stabilizing storage sub-device of the at least two voltage stabilizing storage sub-devices comprises a capacitor and a switch device, and wherein in each voltage stabilizing storage sub-device the switch device is connected between the capacitor and the driving device;

the driving method comprises:

in a data writing stage, transmitting, by the data writing device, a data signal voltage, and storing, by the voltage stabilizing storage device, the data signal voltage;

in a light-emitting stage, each voltage stabilizing storage sub-device storing the data signal voltage comprises an effective voltage stabilizing period, and effective voltage stabilizing periods of the at least two voltage stabilizing storage sub-devices at least do not overlap partially in response to controlling by switch devices of the at least two voltage stabilizing storage sub-devices; and wherein within the effective voltage stabilizing period of each voltage stabilizing storage sub-device, the switch device in the voltage stabilizing storage sub-device is in a conductive state.

12. The driving method of the pixel driving circuit of claim 11, wherein a union of all periods occupied by the effective voltage stabilizing period overlaps with the light-emitting stage.

13. The driving method of the pixel driving circuit of claim 12, wherein the effective voltage stabilizing periods of at least two voltage stabilizing storage sub-devices have different starting occasions.

14. The driving method of the pixel driving circuit of claim 13, wherein an end occasion of the effective voltage stabilizing period of each voltage stabilizing storage sub-device is same as an end occasion of the light-emitting stage.

15. The driving method of the pixel driving circuit of claim 14, wherein the starting occasion of the effective voltage stabilizing period of each voltage stabilizing storage sub-device is different, and a non-overlapping part of any two effective voltage stabilizing periods with adjacent starting occasions has a same time length.

16. The driving method of the pixel driving circuit of claim 12, wherein effective voltage stabilizing periods of any two voltage stabilizing storage sub-devices are not overlapped, and the effective voltage stabilizing period of the each voltage stabilizing storage sub-device has an equal time length.

17. The driving method of the pixel driving circuit of claim 11, wherein the voltage stabilizing storage device storing the data signal voltage comprises:

in response to driving the pixel driving circuit at a first driving frequency, the voltage stabilizing storage device storing the data signal voltage has a first capacitor, and in response to driving the pixel driving circuit at a second driving frequency, the voltage stabilizing storage device storing the data signal voltage has a second capacitor, the first driving frequency is greater than the second driving frequency, and the first capacitor is smaller than the second capacitor.

18. A display panel, comprising the pixel driving circuit of claim 1.

19. A display device, comprising a display panel, wherein the display panel comprises a pixel driving circuit, and the pixel driving circuit comprises: a data writing device, a voltage stabilizing storage device, a driving device and a light-emitting component;

wherein the data writing device is configured for transmitting a data signal voltage;

the driving device is configured for generating a driving current according to the data signal voltage transmitted by the data writing device;

the voltage stabilizing storage device is configured for storing the data signal voltage transmitted to the driving device;

the light-emitting component is configured for emitting light in response to the driving current generated by the driving device;

wherein the voltage stabilizing storage device comprises at least two voltage stabilizing storage sub-devices connected in parallel, each voltage stabilizing storage sub-device of the at least two voltage stabilizing storage sub-devices comprises a capacitor and a switch device, and wherein in each voltage stabilizing storage sub-device the switch device is connected between the capacitor and the driving device;

wherein the voltage stabilizing storage device comprises a first voltage stabilizing storage sub-device and a second voltage stabilizing storage sub-device, and wherein the first voltage stabilizing storage sub-device comprises a first capacitor and a first transistor MIA, a first pole of the first capacitor is connected to a first power signal terminal, a second pole of the first capacitor is connected to a first electrode of the first transistor M1A, a second electrode of the first transistor M1A is connected to the driving device, and a gate of the first transistor M1A is connected to a switch control signal terminal SKA;

wherein the second stabilizing voltage storage sub-device comprises a second capacitor and a first transistor M1B, a first pole of the second capacitor is connected to a first power signal terminal, a second pole of the second capacitor is connected to a first electrode of the first transistor M1B, a second electrode of the first transistor M1B is connected to the driving device, and a gate of the first transistor M1B is connected to a switch control terminal SKB.

* * * * *